US005154489A

United States Patent [19]

Lemieux

[11] Patent Number: 5,154,489

[45] Date of Patent: Oct. 13, 1992

[54] INCLINED SURFACE MINING METHOD

[75] Inventor: Marc Lemieux, Bogotá, Colombia

[73] Assignee: Exxon Coal USA, Inc., Houston, Tex.

[21] Appl. No.: 656,795

[22] Filed: Feb. 15, 1991

[51] Int. Cl.[5] ..... E21C 47/04

[52] U.S. Cl. ..... 299/18; 299/19

[58] Field of Search ..... 299/18, 19, 64

[56] References Cited

U.S. PATENT DOCUMENTS

| | | | |
|---|---|---|---|
| 3,301,599 | 1/1967 | Heimaster | 299/18 |
| 4,017,122 | 4/1977 | Simpson | 299/18 X |
| 4,103,972 | 8/1978 | Kochanowsky | 299/18 |
| 4,133,581 | 1/1979 | Satterwhite | 299/7 |
| 4,150,852 | 4/1979 | McCoy | 299/18 |
| 4,150,853 | 4/1979 | McCoy | 299/18 |
| 4,261,119 | 4/1981 | Kubo et al. | 37/195 |
| 4,290,651 | 9/1981 | Files et al. | 299/7 |
| 4,323,281 | 4/1982 | Greenwald, Sr. et al. | 299/1 |
| 4,453,770 | 6/1984 | Dalrymple et al. | 299/7 |
| 4,589,700 | 5/1986 | Schroder | 299/18 |
| 4,624,504 | 11/1986 | Franke et al. | 299/18 |
| 4,979,781 | 12/1990 | Bothwell et al. | 299/18 |

FOREIGN PATENT DOCUMENTS

| | | | |
|---|---|---|---|
| 266829 | 4/1989 | Fed. Rep. of Germany | 299/64 |
| 622978 | 9/1978 | U.S.S.R. . | |
| 641100 | 1/1979 | U.S.S.R. | 299/19 |
| 694639 | 10/1979 | U.S.S.R. . | |
| 723136 | 3/1980 | U.S.S.R. . | |
| 798300 | 1/1981 | U.S.S.R. . | |

OTHER PUBLICATIONS

"The Development of Continuous Surface Mining Technology for Hard Materials", Rolf Sagner, *Mine Planning and Equipment Selection*, pp. 13–23, 1990.

*Tagebau-Technik* Band 1 (Open Mining Technique), published 1979 (with English translation) pp. 1–27.

*Satterwhite Industries* drawing, 1985.

*A New Dimension in Movable Conveyors for Bulk Solids Handling*, "Bulk Solids Handling", vol. 2, No. 3, Sep. 1982, pp. 459–464.

*Entwicklungstendenzen '70 der Tagebautechnik des rheinischen Braunkohlenbergbaus*, 1970 (with English translation).

*Primary Examiner*—David J. Bagnell

*Attorney, Agent, or Firm*—Vaden, Eickenroht, Thompson, Boulware & Feather

[57] ABSTRACT

There is disclosed a method of surface mining wherein a continuous surface miner is moved up and down an inclined surface to remove adjacent strips of material, which may be valuable commodity and/or waste, and the excavated material is transferred to a mobile conveyor which extends along the inclined surface generally parallel to the continuous surface miner.

27 Claims, 23 Drawing Sheets

FIG. 1
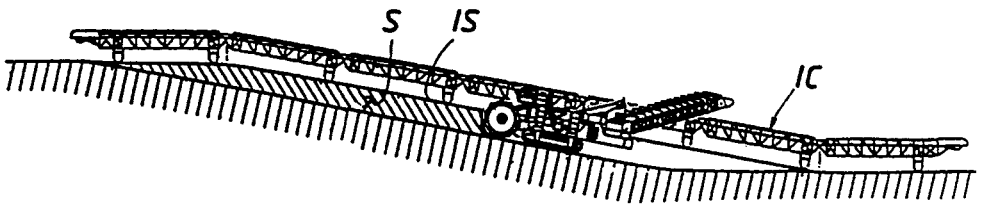
FIG. 1A
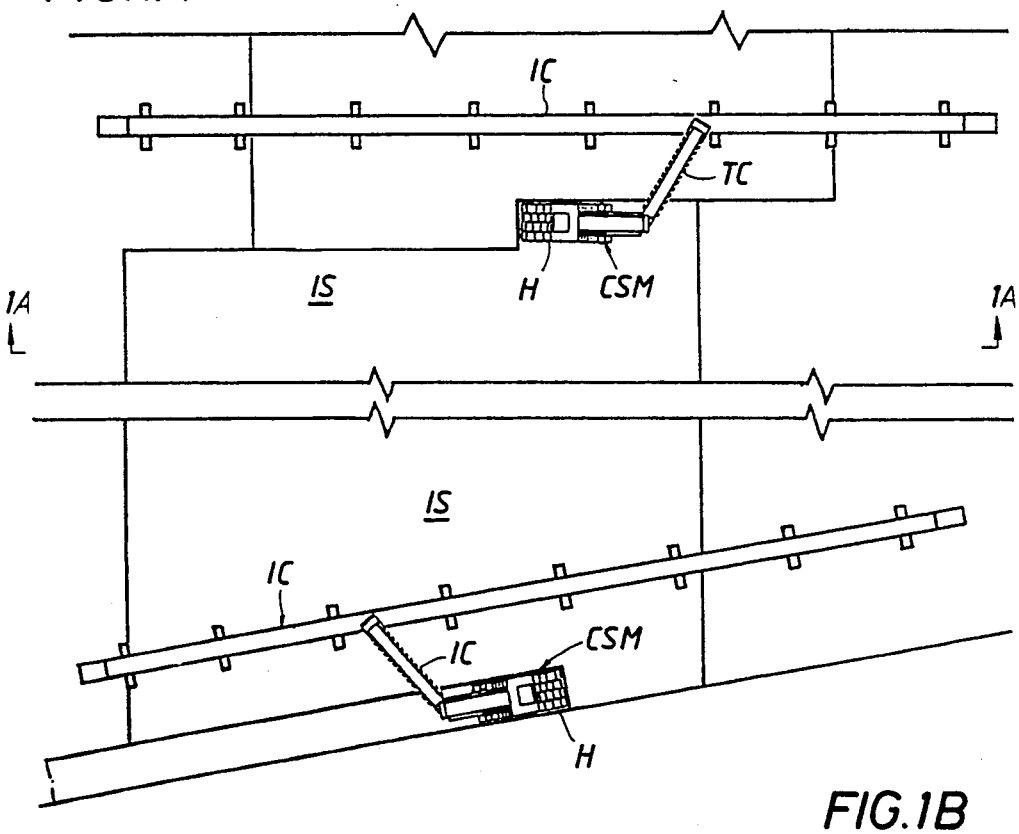
FIG. 1B

FIG. 2
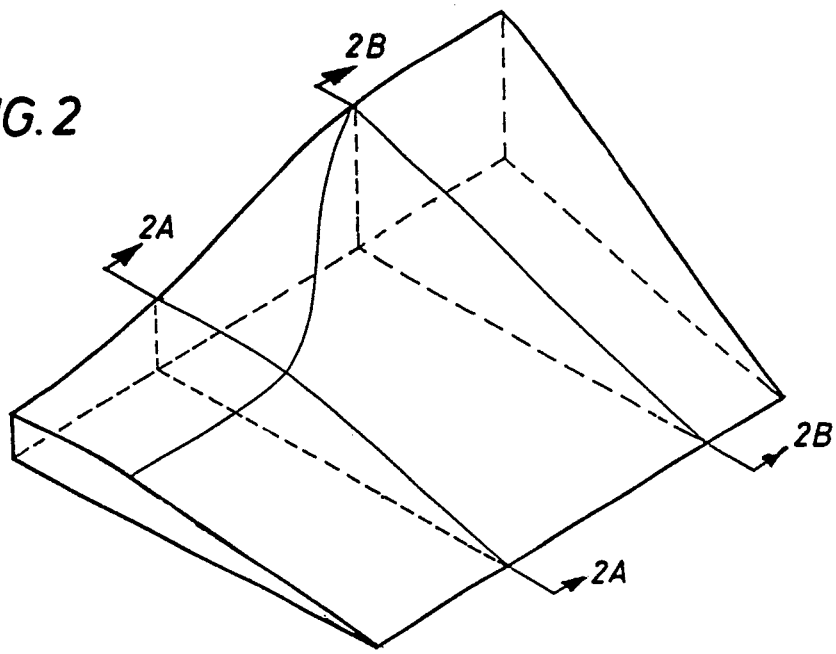
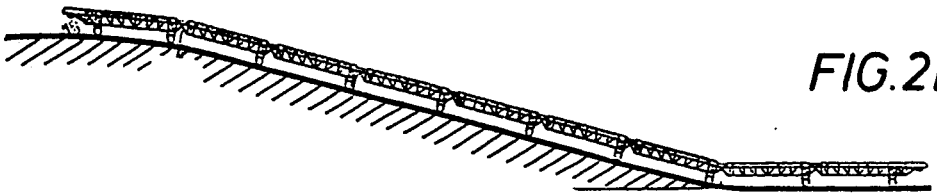
FIG. 2B
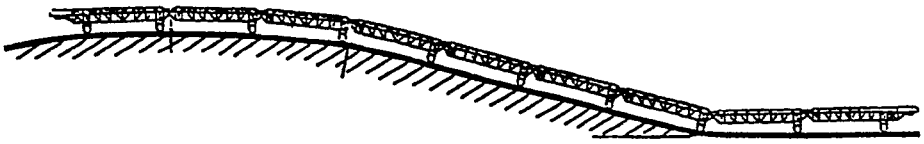
FIG. 2A

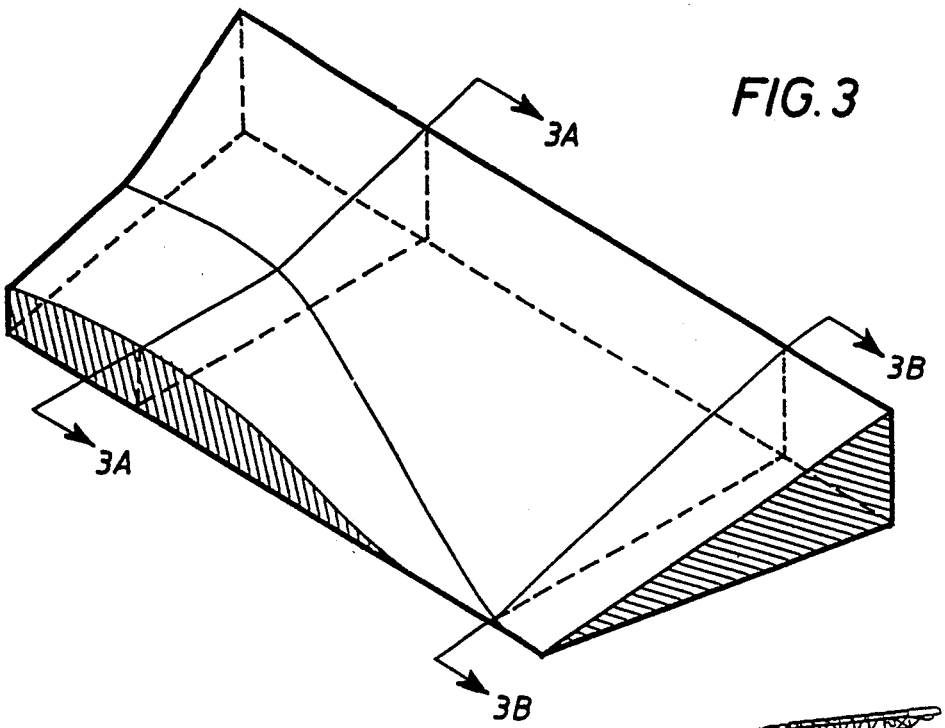
FIG. 3
FIG. 3A
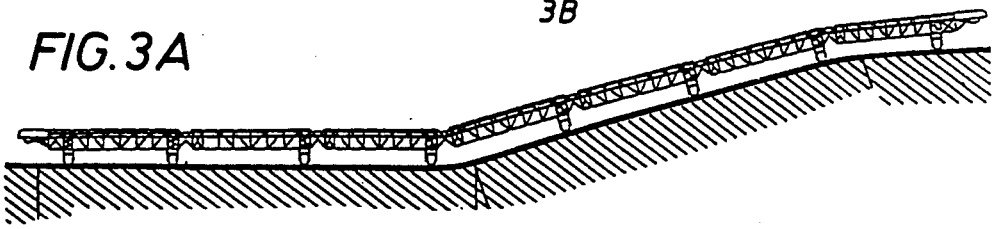
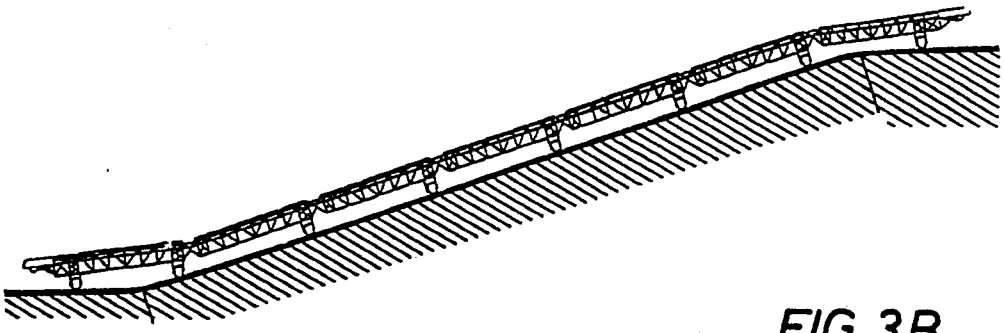
FIG. 3B

FIG. 6
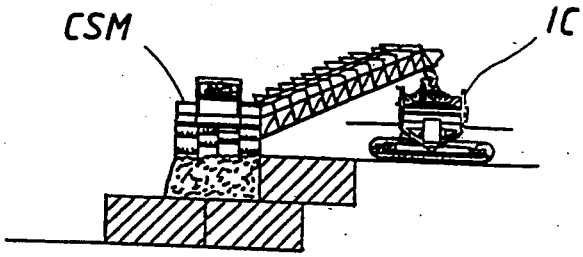
FIG. 7
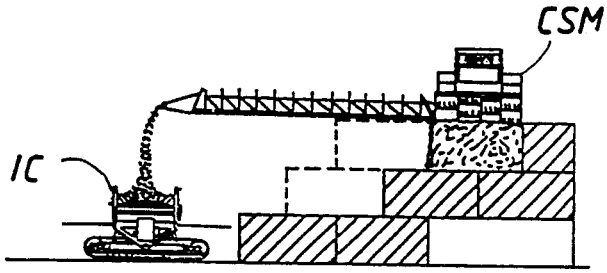
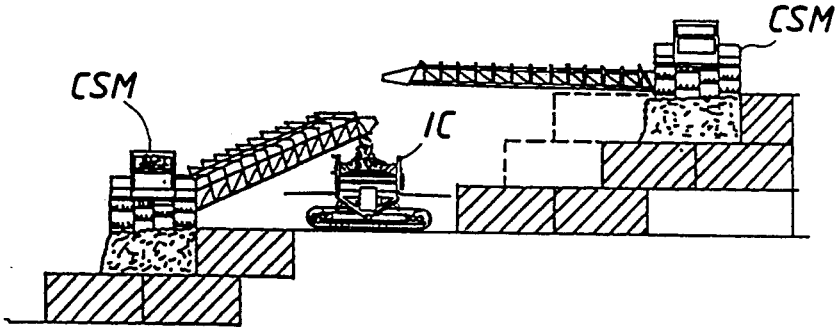
FIG. 8

FIG.9A
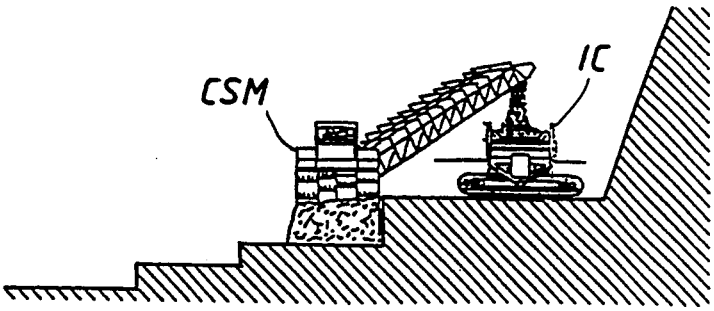
FIG.9B
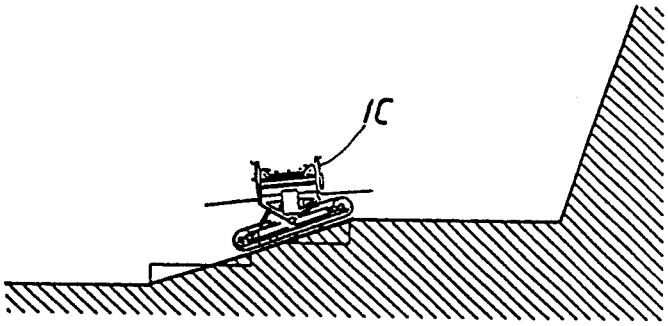
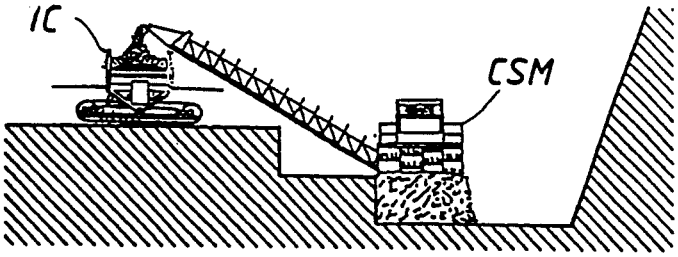
FIG.9C

FIG. 10A
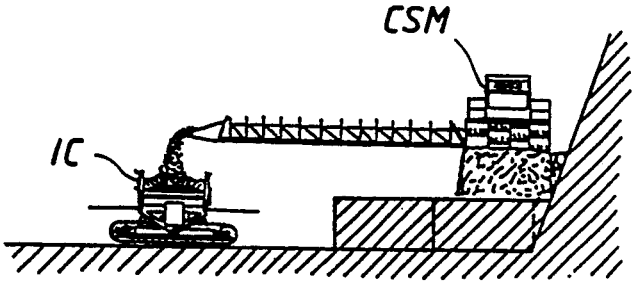
FIG. 10B
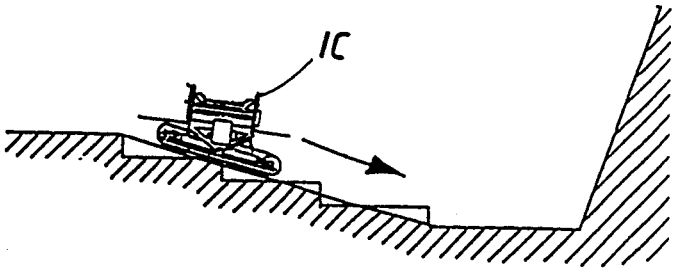
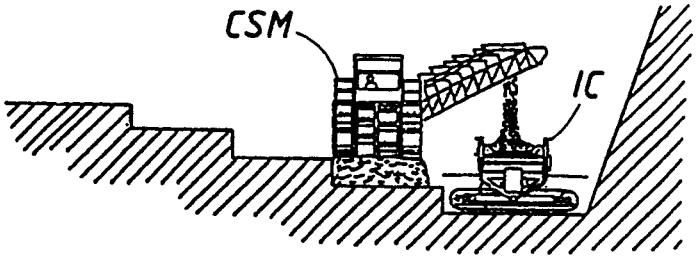
FIG. 10C

FIG. 11A
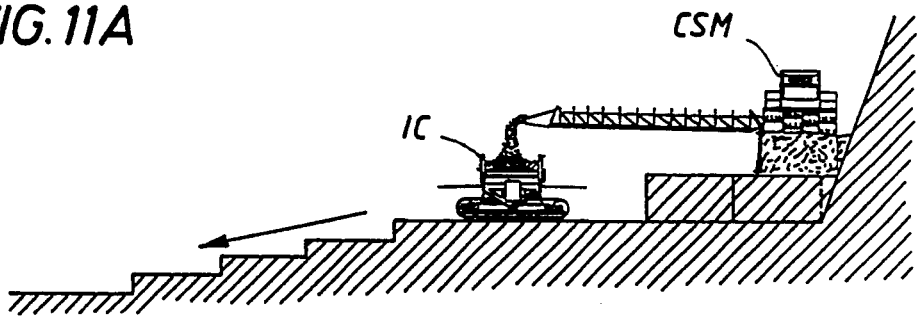
FIG. 11B
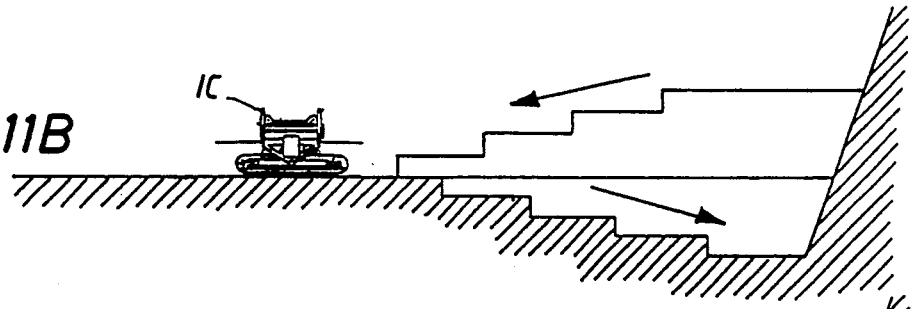
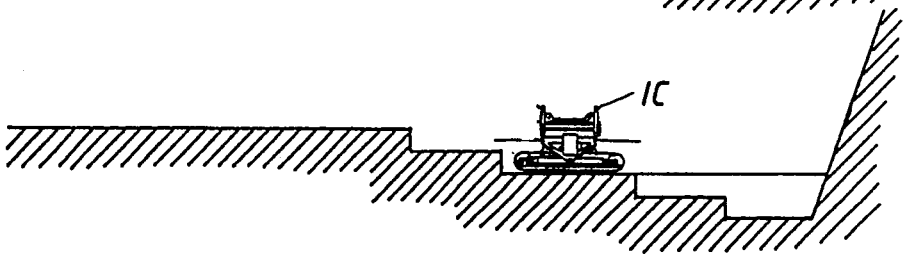
FIG. 11C

FIG.11A-1
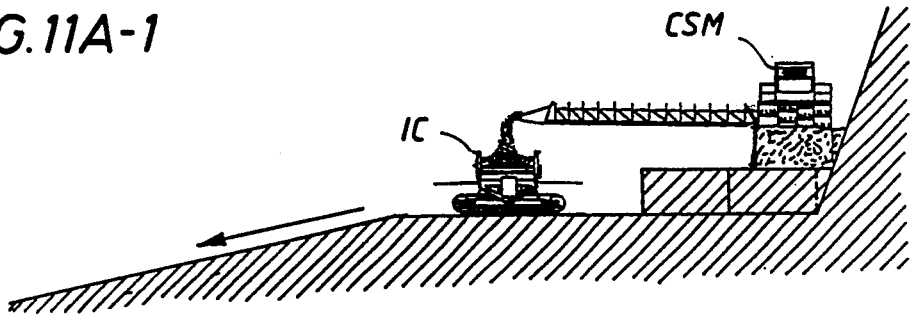
FIG.11B-1
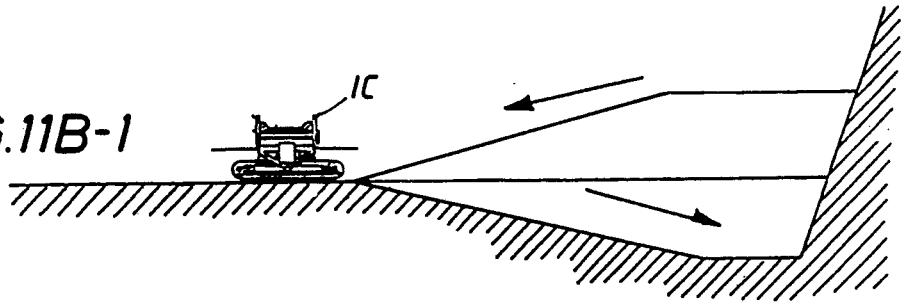
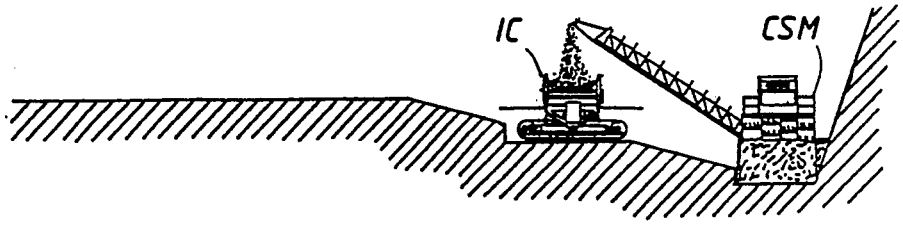
FIG.11C-1

FIG.14A
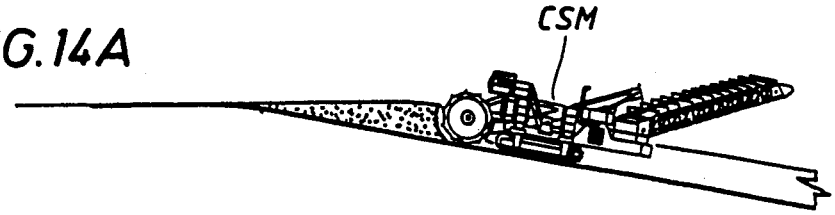
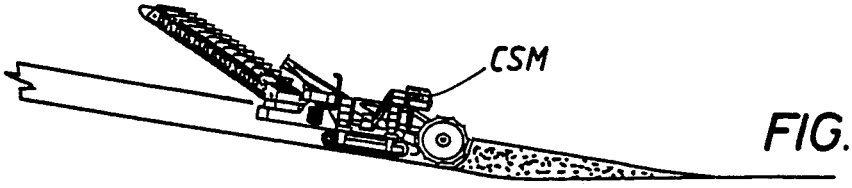
FIG.14B
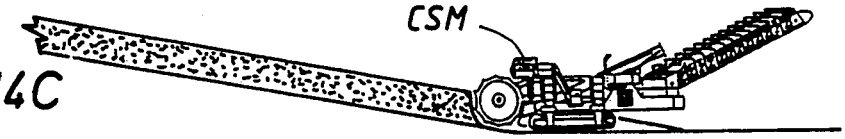
FIG.14C
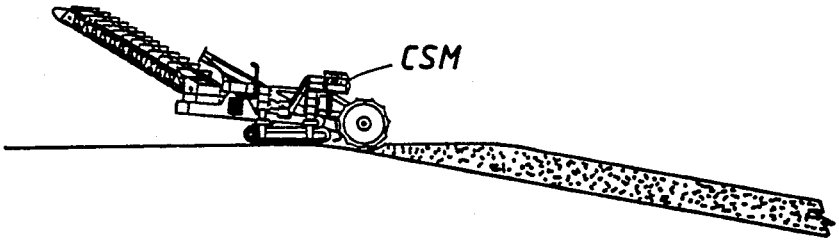
FIG.14D

INCLINED SURFACE MINING METHOD

This invention relates in general to surface mining, and, more particularly, to an improved method of surface mining wherein valuable commodities and/or waste are excavated from an inclined mine surface.

As compared with the well known process of mining through tunnels, surface mining involves the excavation of valuable commodities ( e.g, coal) or waste, which may or may not be associated with the valuable commodities, close to the earth's surface. In accordance with present practices, this involves the excavation of approximately horizontal slices called "benches", each typically excavated in a series of cuts or advances scheduled to coordinate with the excavation of overlying and underlying benches, if any. The excavator may be an electrically or hydraulically powered shovel, a front end loader, a bucket wheel excavator, a backhoe, a dragline or a continuous surface miner. The materials excavated by the excavators are transported from the mining area by either trains, trucks or conveyor systems which are established to operate on the benches, although, in certain situations, the excavated material may be cast directly into an adjacent area.

The ability of an excavator to reach and scale the bank developed by the excavator sets the maximum safe vertical height of a bench. As the depth of the excavation increases beyond the maximum safe bench height, additional benches and associated excavation and/or transportation systems are required to remove the excavated material from the active faces of the mine.

Lesser bench heights may be set by the geometry of the material being excavated such as coal seam and parting thickness. Lesser bench heights may also be dictated by recovery, dilution, or grade/quality control considerations. Lesser bench heights than the maximum safe heights lead to additional excavation and/or transportation systems.

Excavated materials are typically transported from a bench by truck or conveyor. When excavated material is conveyed it is typically transported by a transfer conveyor to a face conveyor for transportation from the bench. The transfer conveyor allows the excavator to excavate wider advances, and thus minimizes the frequency of moves required of the face conveyor to remain within the reach of the excavator. The face conveyor is typically moved in a direction approximately normal to its long axis, towards the face of the material to be excavated after an advance is completed.

Coordinating a continuous surface miner with a conveyor assumes the conveyor is generally horizontal and parallel to the face of material being excavated and that the miner discharges to the conveyor while excavating parallel to it. A transfer conveyor between the miner and the parallel face conveyor would move with the miner as it advances.

The transfer conveyor extends the width of the excavation prior to moving the face conveyor to keep it within the range of the excavator. After the miner excavates an area parallel to the conveyor, where width is limited by the excavator discharge boom length or the discharge boom length plus the transfer conveyor's reach, the conveyor is moved forward so that the next advance of material can be excavated.

The height of the bench on which a continuous surface miner may operate is limited by the vertical reach of the miner's conveyor and the transfer conveyor, if included. As a result, the overall vertical reach of this type of system is typically lower than with other types of mining equipment.

As with other mining systems, seam thickness, recovery, dilution and quality control considerations can determine the benching configuration and the number of the excavation and/or transportation systems required for the horizontal application of a continuous surface miner and conveyors. If the overburden is thicker than the continuous surface miner bench, then more than one transportation system would be required. For instance, to use only one face conveyor in deeper excavations would require that the face conveyor be lowered with the excavation. When the bottom of the excavation is reached, the face conveyor would need to be moved in pieces or as a unit to the top of the next advance. This is not generally considered a viable option.

To avoid the problem of conveying systems limiting the use of continuous surface miners, several proposals have been made to use it in mining on an incline. These proposals have assumed that the incline is maintained within an advance and that the dip of the incline is normal to the overall mine advance direction. Each advance is mined by excavating a ramp at one end of the advance and progressing it to the other end. The ramp must then be progressed into the next advance and the dip of the next ramp established in the reverse direction.

Several alternative transportation systems have been proposed to support a continuous surface miner working on an incline oriented as described above. However, the use of conveyors in this arrangement leads to problems with coordinating the change of direction of the slope, when progressing from one advance to the next, with the movement of the conveyors and other elements of the transportation system.

An alternative transportation system envisions the continuous surface miner discharging to a cross pit conveyor following the miner on the slope. This cross pit conveyor in turn casts the material into the backfill. This system again has problems in coordinating the excavation and movement of equipment from one advance to another and providing a cross pit spreader with sufficient reach.

It would be desirable, and is therefore an object of this invention, to provide a method of surface mining which avoids these problems of conventional "benching" techniques, including those associated with moving the conveyors from one advance to the next and coordinating that movement with the subsequent transportation system whether in the form of trucks, conveyors, or something else, as well as the problems above described in connection with prior inclined mining surface proposals. More particularly, it would be desirable and thus a further object to reduce the number of excavation and/or transportation systems by facilitating the movement of the excavator and transportation systems from one advance to the next and coordinating material movement with the excavation system. This would lower the capital expenditures as well as the operating costs caused by limitations on safe working heights or by situations due to special seam thickness, recovery, dilution and/or quality control problems.

Thus, according to this invention, a surface mining method is provided which permits a continuous surface miner to be matched to mobile conveyors, both working on an incline with a slope oriented in the direction of the mine advance. More particularly, the benches are eliminated and the advancing face is instead laid back to an angle upon which mobile conveyors, continuous surface miners, and associated support equipment such as dozers and graders may operate, typically between 10 and 15 percent (10–15%) but lesser or greater depending on the application and the equipment. The development of a mine surface to accommodate the system of this invention necessitates that the advancing face be laid back to a suitable working angle as described above. If there is a thick waste layer over the commodity to be recovered, there may be a requirement to excavate a relatively large quantity of material to establish the necessary laid back face. However, the expense of developing the lay back is, in general, offset by the reduction in capital expenditures required to develop multiple bench excavation and/or transportation systems, the associated operating cost savings and the overall benefit of simplicity in managing the inclined mining system.

A continuous surface miner is then able to excavate up and/or down the dip of the sloped face, discharging its material to a mobile conveyor operating on the incline by means of a hopper car or equivalent device to transfer material from the discharge conveyor of the continuous surface miner to the mobile conveyor which has the capability of traveling across the strike of the slope. While the continuous surface miner and mobile inclined conveyor generally operate up and down dip, they may be manipulated to either side of the dip to accommodate certain mining requirements. The mobile inclined conveyor may either carry the material up grade or down grade to deposit it on a face conveyor, in a truck, in a hopper to be loaded to a truck or conveyor, on the ground for rehandling, onto a cross pit spreader or directly into the backfill in certain applications.

The redundant conventional excavating and/or transportation systems associated with multiple benches necessitated by safety considerations can be eliminated by lengthening the sloping face and the use of mobile inclined conveyors to cover a number of benches. Therefore, a single bench transportation system, one excavator and one mobile incline conveyor, can replace several conventional systems and/or several working benches.

Advancing the pit on the incline provides an opportunity to improve the control of the design and construction of the end wall of the mine. As fewer transportation systems are required, fewer benches on the end wall are required to carry the transportation systems, whether roads and ramps for trucks or conveyors. This should reduce the overall material required to be excavated to develop the transportation system thereby reducing costs. Secondly, as the end wall is developed by the excavator in relatively thin slices on the incline, the wall should be well cleaned and free from blast damage thereby improving its stability. Because of the access to the wall, the wall can be sculpted to meet specific slope design criteria. This should also help reduce volumes required to establish the safe slopes and reduce associated costs.

Mining on the incline should offer some advantages in the management of both surface and ground water. Water tends to pool on horizontal benches causing muddy areas that tend to get worse as the area is repeatedly disturbed. If the area has been blasted, water frequently will pool in the shattered subgrade exacerbating the problem. By working on the slope, the water will drain to the toe of the slope.

As the material of the sloped face is undisturbed, mud development and rilling from run off should be minimal. Since the machine excavates the surface and the crawlers on the excavator travel immediately behind a fresh cut, surface mud and rilling should be no problem for the excavator. For the same reasons, snow and ice should not be a major problem.

The mobile inclined conveyor movement should not be unduly hampered by mud, rilling, and snow. A grader can be used to maintain the surface prior to moving the mobile inclined conveyor ahead. The mobile inclined conveyor should be able to "crab" uphill as it advances to overcome any tendency to slip or creep down hill as it crosses the slope. Suitable crawler pad design will also help to mitigate the problem of working on icy or slippery slopes.

In the mining system of this invention, the slope is disturbed in a series of slices and the crawlers cross a surface only once. As the area is then left undisturbed until the entire advance is completed before returning, the ground water flowing out of the slope should be a relatively small problem, as compared to more conventional mining methods. This provides the slope the opportunity to drain. The slope itself provides the necessary gradient. Good water management should be achieved at reduced costs. The drained slope should provide a firmer base for equipment operations.

Spontaneous combustion of coal is exacerbated by conditions where blasting shatters the coal and it is not completely excavated or where coal fines collect at the toe of benches. Frequently, reabsorption of water into the shattered coal or coal fines and the circulation of air create the conditions for spontaneous combustion. The use of the continuous surface miner avoids the shattering effect of blasting and the inclined slope leaves few places for coal fines to accumulate in depth. These factors should minimize the propensity for the coal to spontaneously combust thereby reducing costs associated with coal fire control and management.

It is commonly observed in the surface mining of coal that the coal faces left to stand for extended periods tend to dry out, thereby reducing the moisture content and increasing the heating value (BTU's) of the coal. In the inclined mining of coal, the movement of the excavation across the face leaves time for the coal face to lose some of its moisture to evaporation and run off between advances. The slope of the coal face facilitates the run off.

Conventional bench mining tends to result in moisture from precipitation accumulating on top of benches, seeping into blasted coal reserves. During wet periods this reduces or reverses the benefits realized from blasting the coal ahead of time to let surface moisture drain or evaporate. In the inclined mining system precipitation will not pool on the top of coal or seep into the coal, offsetting the benefits of natural drying. The shallowness of each advance and larger exposed surface area mean relatively less time is required to effect some drying than with a thicker, more compact advance.

Use of one or more mobile conveyors in accordance with the present invention permits excavated material to be conveyed to a top of slope transportation system, to a bottom of slope transportation system, to a top or bottom of the slope transportation system by reversing the conveyor belts, or, in the case of two separate mobile inclined conveyors, one may convey down slope and the other up slope to a central transportation system. As will be apparent from the description to follow, there are a number of variations of these four basic conveying systems that can be incorporated to enhance flexibility and reliability of the overall systems.

It has also been proposed by others, prior to my invention, to excavate material on a sloped surface by moving a continuous surface miner parallel to the dip of the incline with a conveyor operating parallel to the direction of travel of the miner to permit the material to be transferred from the miner to the conveyor. The material from the sloped conveyor system is transferred to a conveyor system at either the top or bottom of the excavated slope, and the material is then transported to some destination. However, as compared with the continuous surface miner contemplated by the present invention, which is of a construction to permit it to discharge to either side and thus while moving up or down the incline, the continuous surface miner previously proposed was capable of operating in one direction only so that it had to be "deadheaded" (moved without excavating any material) back to the start of a cut before excavation could be continued, thus resulting in lost production during deadheads back to the start of the cut.

Also, the previously proposed inclined conveying system was divided into numerous short conveyor segments leading to a top or bottom of slope conveyor. Although the control and movement of each individual short mobile conveyor is technically less complex than that of a long crawler mounted conveyor having flexibly connected end-to-end jointly mobile segments with a common continuous conveyor belt, as contemplated by the present invention, the multiplicity of individual conveyor movements is manpower intensive and ultimately more complex from an operations viewpoint. The complexity of a segmented conveyor movement comes from managing the trailing power cables and the realignment of the transfer points for each segment as they are relocated.

The numerous transfer points are also likely to result in system shutdowns due to transfer point plugging or transfer point misalignment. The cost of transfer point maintenance is multiplied by the number of transfer points in the system. Thus, each multiple conveyor segment requires a separate motor, speed reducer, head and tail pulley along with separate supporting trailing cable. The multiple conveyor segments would therefore result in high capital, operating cost and lower operating availability for the same length of conveyor system as would a single flight conveyor system, as in the present invention.

When one full slice across the entire sloping face has been removed, and another slice started, there will be a vertical drop between the one slice and the next. One of the perceived advantages of short segmented conveyors is the ability to move them to the top or bottom of the slope when a complete slice has been removed. The conveyors can then be relocated on a lower slice avoiding the vertical drop between the two slices. However, this approach to moving the inclined conveyor from one slice to another would not work with a long single flight conveyor unless there is sufficient space to pull the conveyor off the slope, and for longer slopes, it would be very costly to open sufficient pit to make this space available.

The numerous short conveyor segments with multiple flights limits the direction of conveying to one direction only, and precludes the use of a mobile cable reel that can ride continuously up or down the length of the conveyor. This becomes important if the excavator is made into an all electric machine with the trailing cable mounted on a reel, and the reel in turn mounted on the conveyor. The reel will pay out and take in the trailing cable laying it in a trough on the conveyor. A short length of trailing cable would be managed between the conveyor and the excavator. The segmented conveyor also precludes the use of a hopper car in conjunction with the transfer of material to the slope conveyor.

The proposal requires different systems to effect the segregation of different materials, which is very awkward to make work. At some point, the parting system's position must be exchanged with the position of the coal system. When this occurs, the top of slope conveyor must be shared by coal and overburden operations occurring at separate times. The segmented down slope waste conveyor or the up slope coal conveyor must be moved in segments around the other conveyor and associated vertical drop between the two surfaces. Then in order to use the segmented top of slope conveyor to move the parting from the excavator to the down slope conveyor, one of the top of slope conveyors must be moved and the down slope conveyor inserted under a transfer point. The process must be reversed the next time the valuable product is to be produced. In order to use the full dump space at the bottom of the slope, the down slope conveyor must be pivoted about the transfer point so the spreader can discharge over the length of the top of the slope conveyor segment. Alternatively, the spreader at the bottom of the slope must have sufficient reach to accomplish the same result.

The previously proposed continuous surface miner can only load a conveyor that is located on or below the same level as the miner because it discharges on the side opposite from the excavator drum. However, a continuous surface miner of the type contemplated by the present invention can work above, on the same level, or below the conveyor. It can also work on both sides of the conveyor, one side above and one side below by moving around one end of the conveyor in order to complete the cross face excavation and movement for the inclined conveyor. Two surface miners could also be assigned to loading the same conveyor.

In accordance with the present invention, the inclined conveyor is moved from one level to another by developing ramps in front of each crawler and moving the conveyor down from one slice to the next. The ramps can be developed by dozing down the face and making a ramp for the crawlers or by spreading material excavated by the surface miner with the slewable and lufable discharge conveyor. The advantage of moving the conveyor from one level to another by a lateral walk down the ramps is the simplicity of the move and the limitation of time lost in movement. The simplicity comes from not being required to move conveyors up and down slope significant distances, to manage the electrical feed lines to each conveyor segment to effect the move and to realign and connect the transfer points. Thus, the method of the invention is significantly more efficient because it is less manpower intensive and involves less downtime.

Multiple short conveyors allow the inclined conveyor to be lengthened or shortened by adding or removing segments and thus allow for variations in topography of the top or bottom of the cut to be accommodated as the slope length changes. However, the method of the present invention allows the variation in length of conveyor to be accommodated by letting the excess length of conveyor extend over the crest of the slope or beyond the toe of the slope, and does not require addition and removal of sections.

Another advantage of the present invention is the ability to use one system to serve the function of collecting the valuable products from one zone while rejecting the waste products from another. One way the waste product can be segregated is for the conveyor belts to move the material directly across the pit into the waste dump. Alternatively, the valuable products could be conveyed in the same direction and segregated at some transfer point further down the system for transportation to the processing/shipping facilities or the waste disposal. The utilization of one system to handle both waste and valuable products will significantly reduce the capital costs relative to a mining method that requires a separate system for different components.

In the drawings, wherein like reference characters are used throughout to designate like parts:

FIG. 1A is a plan view of the inclined surface, miner and conveyor of FIG. 1A;

FIG. 1B is another plan view of the inclined surface, but showing the miner moving downwardly therealong adjacent to a wall arranged at a small angle with respect to the advance;

FIG. 2 is a perspective view of an inclined mine surface which varies in length across the strike of the surface;

FIG. 2A is a vertical sectional view showing a mobile conveyor disposed along a portion of the inclined surface indicated by broken lines A—A of FIG. 2;

FIG. 2B is a view similar to FIG. 2A but with the conveyor arranged along the portion of the surface indicated by broken lines B—B of FIG. 2;

FIG. 3 is a perspective view of an inclined mine surface which varies in length along the strike thereof;

FIG. 3A is a vertical sectional view of a mobile conveyor disposed along a portion of the mine surface indicted by broken lines 3A—3A of FIG. 3;

FIG. 3B is a view similar to FIG. 3A but showing the conveyor disposed along the surface indicated by broken lines 3B—3B of FIG. 3;

FIGS. 6, 7 and 8 are cross-sectional views of a portion of an inclined mine surface with a continuous surface miner and mobile conveyor operating on different levels relative to one another;

Figures 1, 9A:
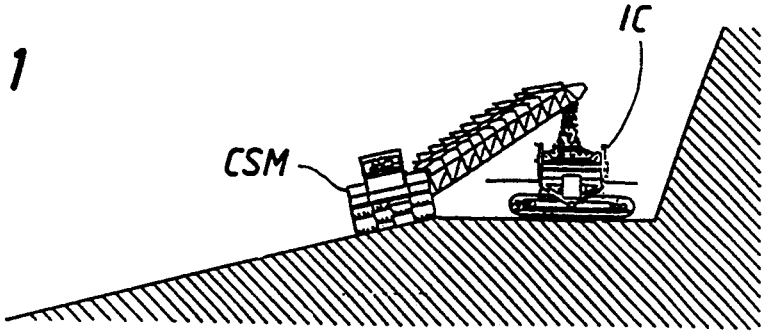
FIG. 1 is a vertical sectional view of an inclined mine surface, as seen along broken lines 1A—1A of FIG. 1A, and showing a continuous surface miner moving upwardly therealong and a mobile conveyor disposed along the inclined surface to one side of the miner.
Figures 1, 9B:
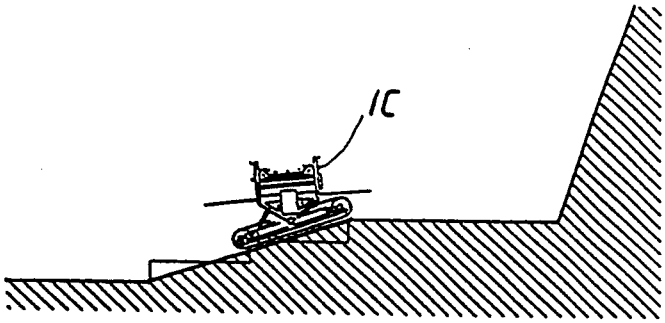
Figures 1, 9C:
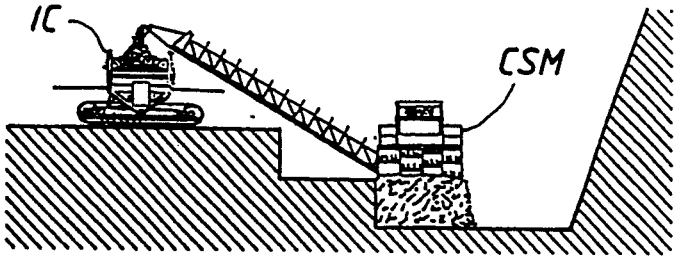
Figures 1, 10A:
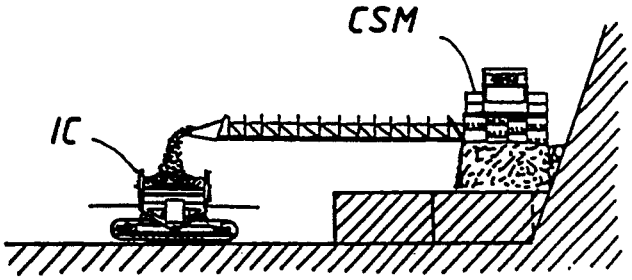
Figures 1, 10B:
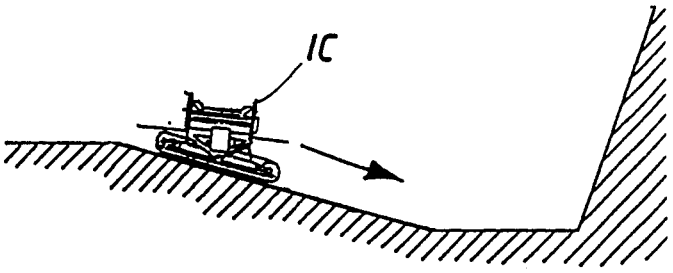
Figures 1, 10C:
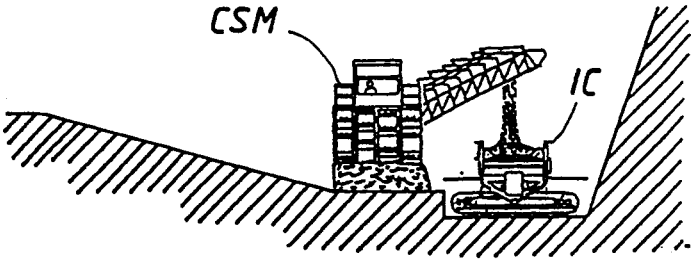
Figure 12A:
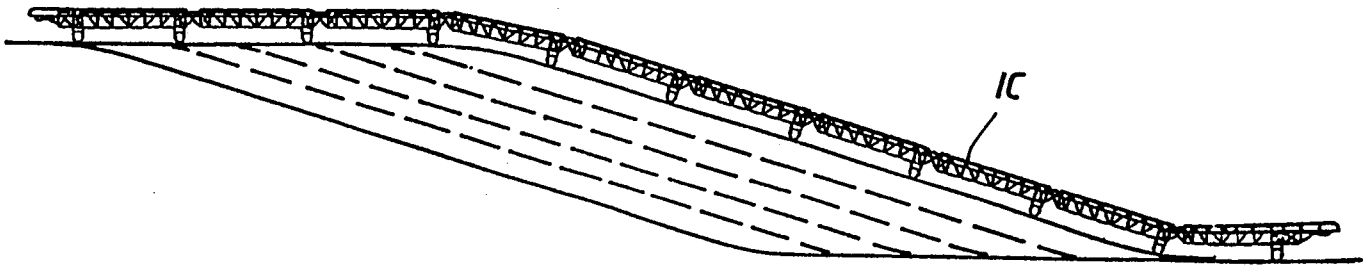
Figure 12B:
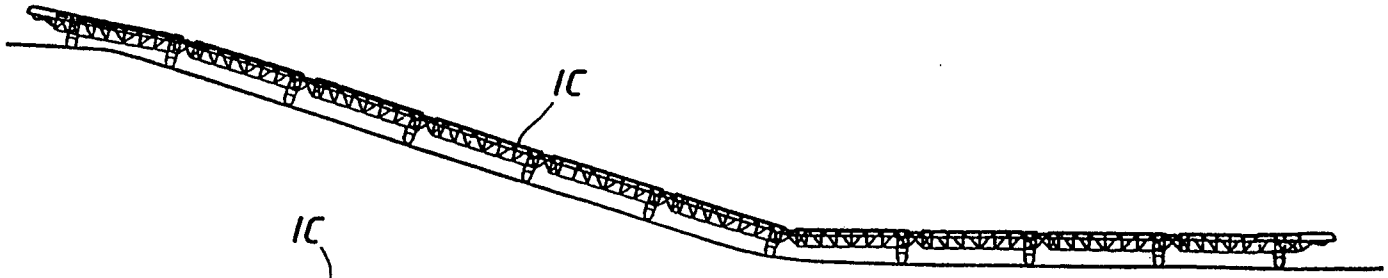
Figure 12C:
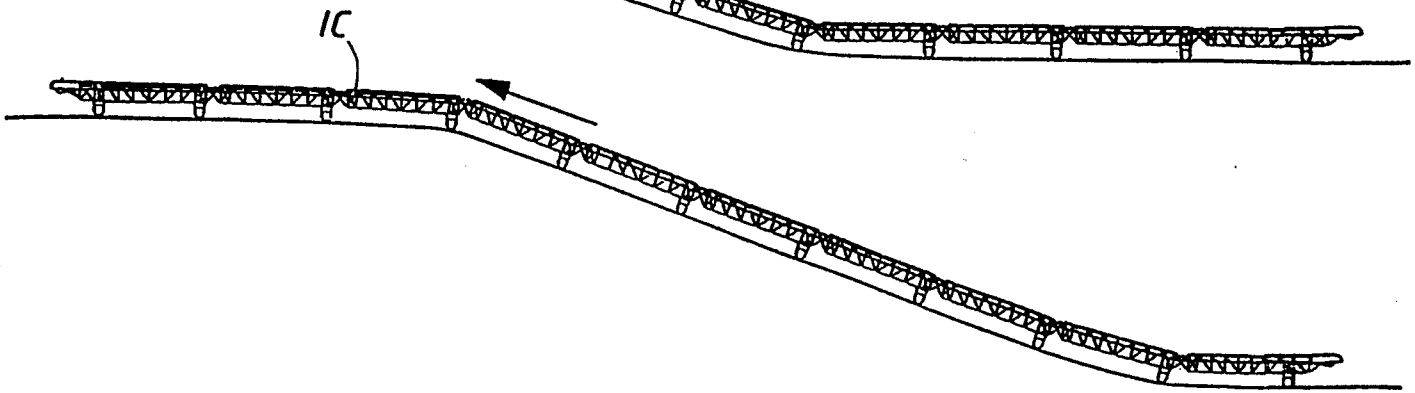
Figure 13A:
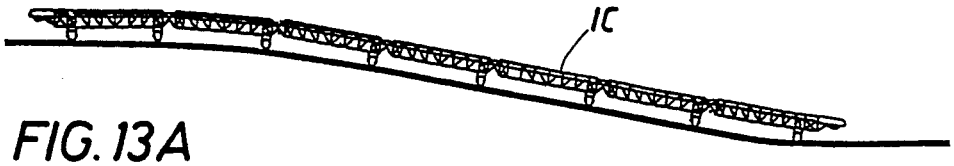
Figure 13B:
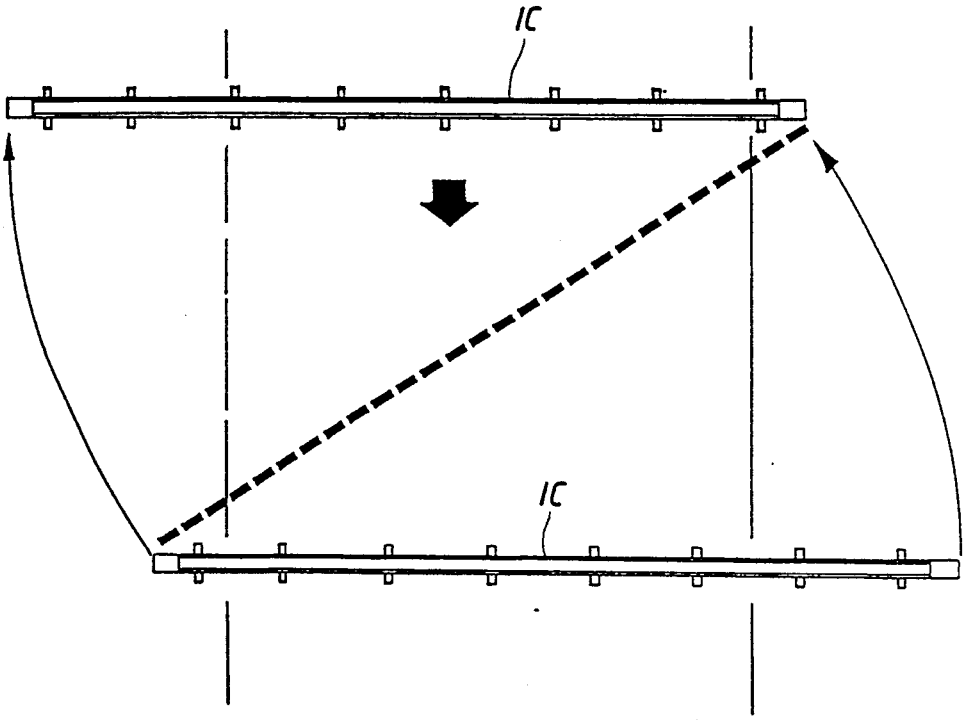
Figure 15A:
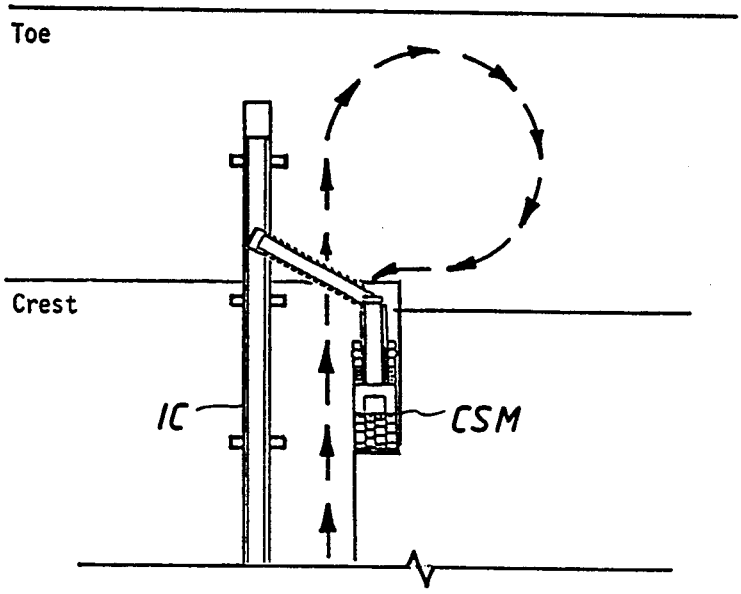
Figure 15B:
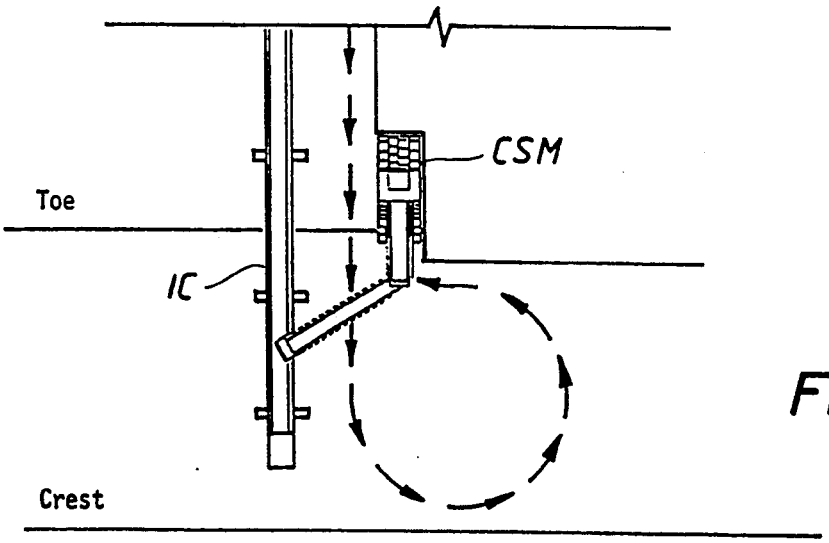
Figure 16A:
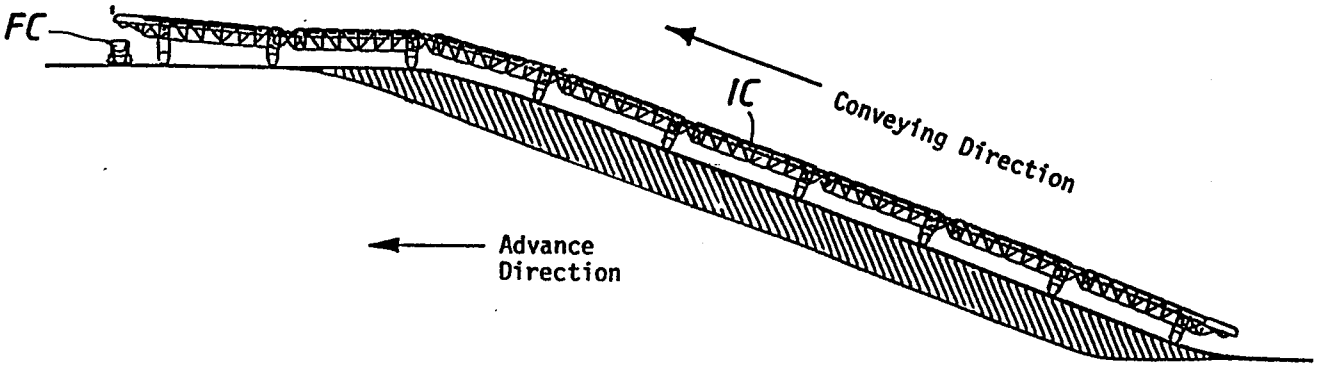
Figure 16B:
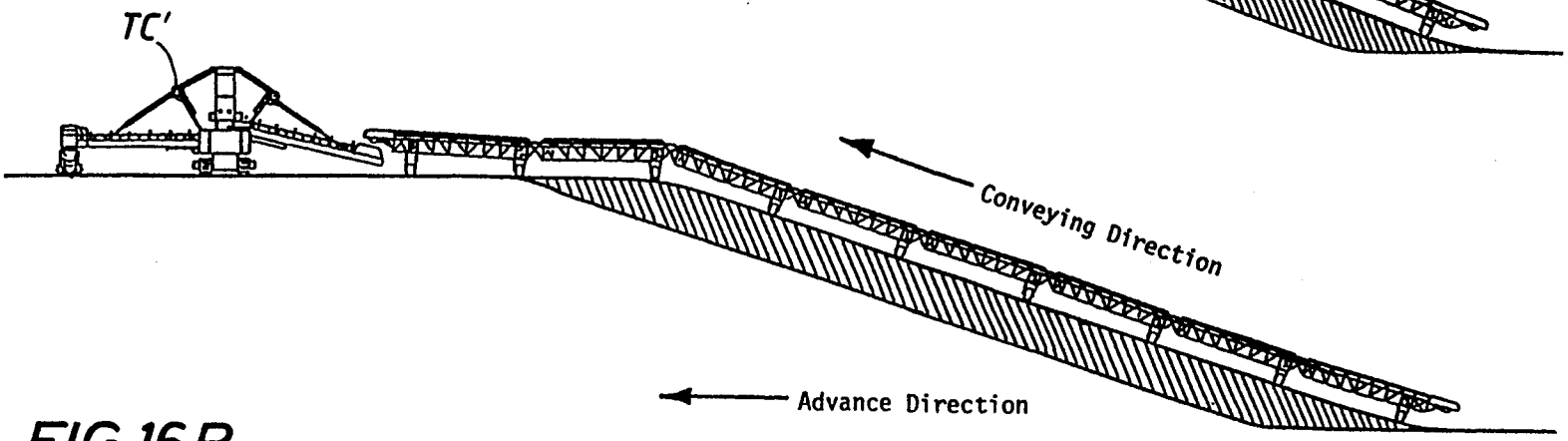
Figure 17A:
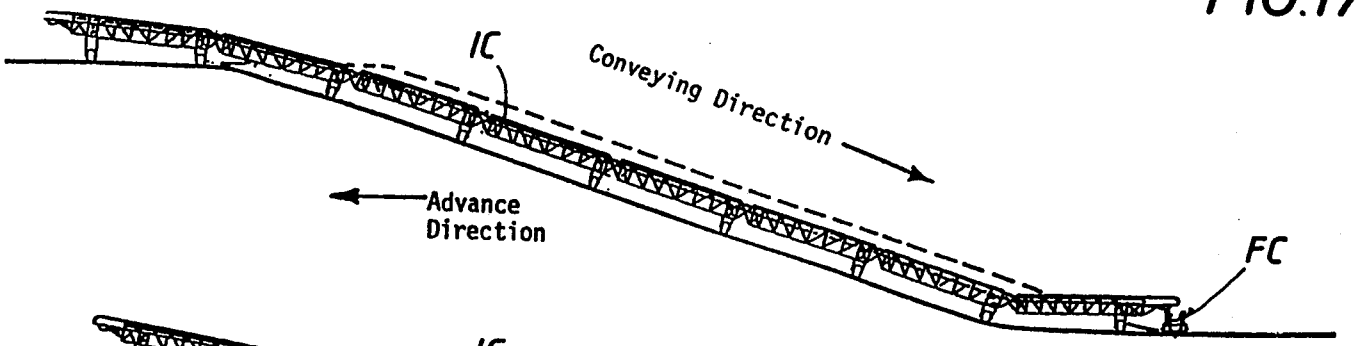
Figure 17B:
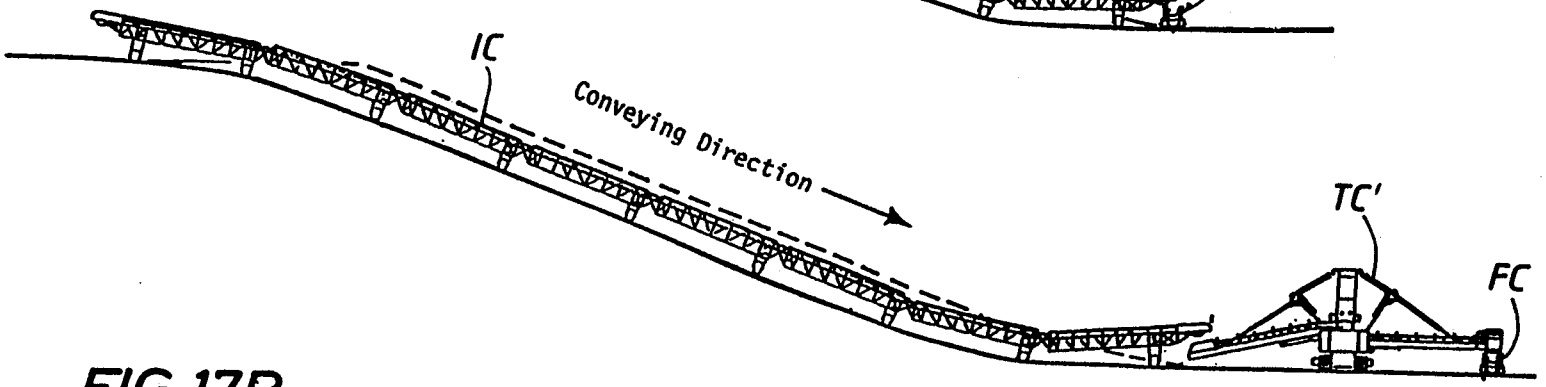
Figures 18A, 18B:
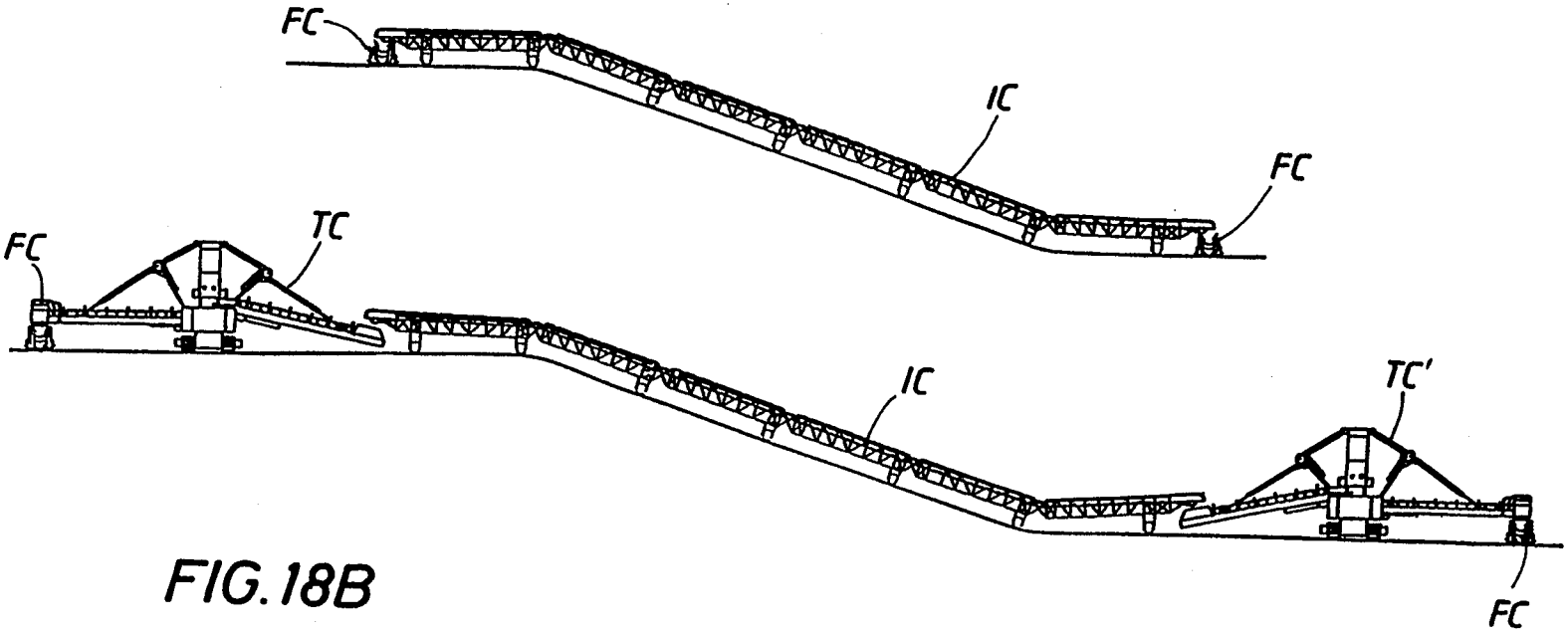
Figure 19:
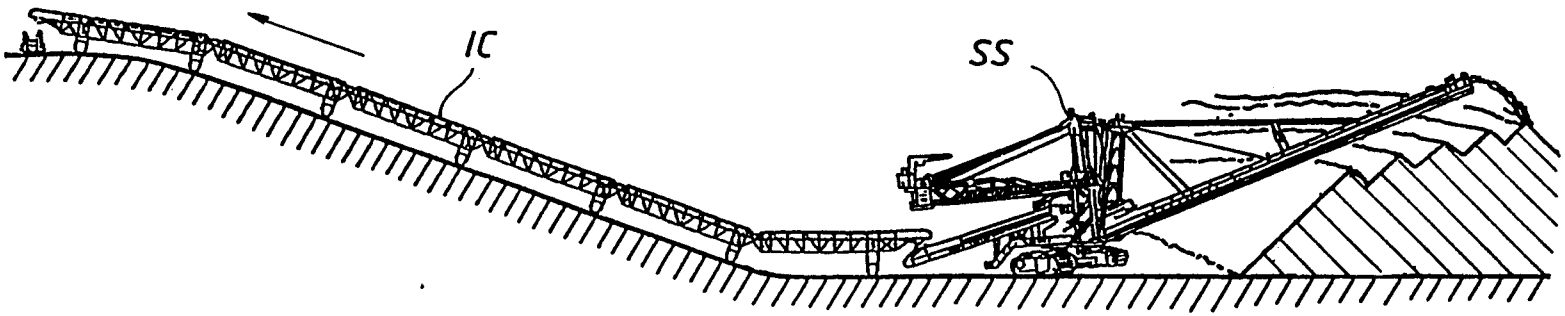
Figure 20:
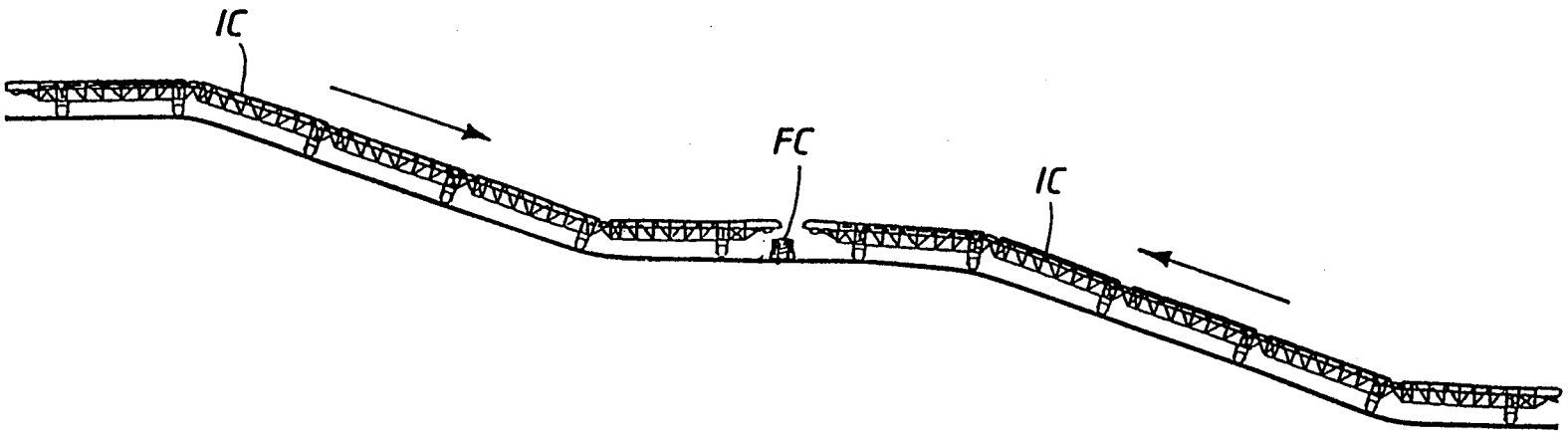
Figure 21A:
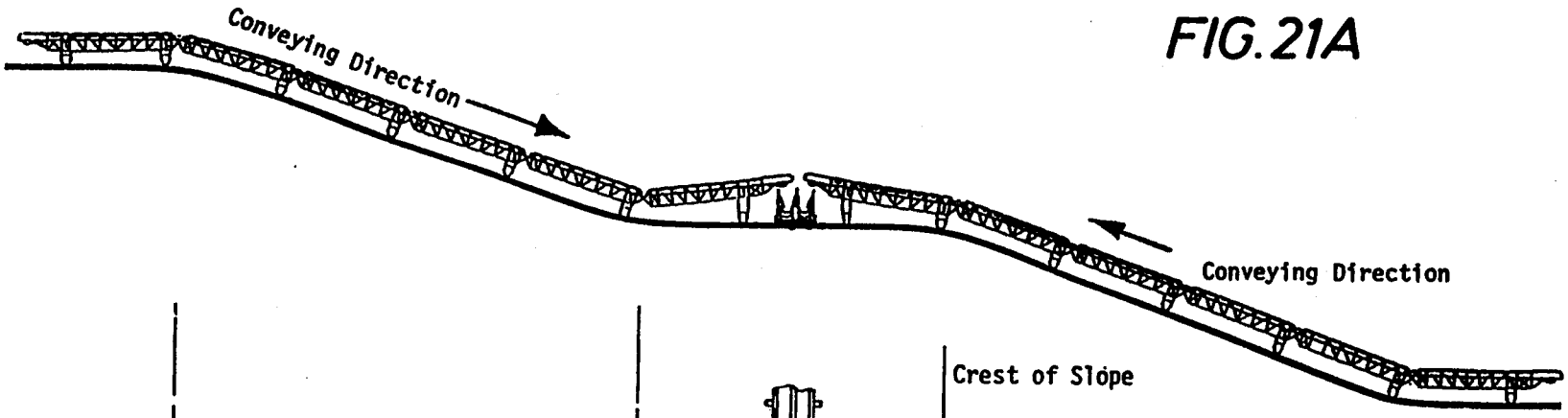
Figure 21B:
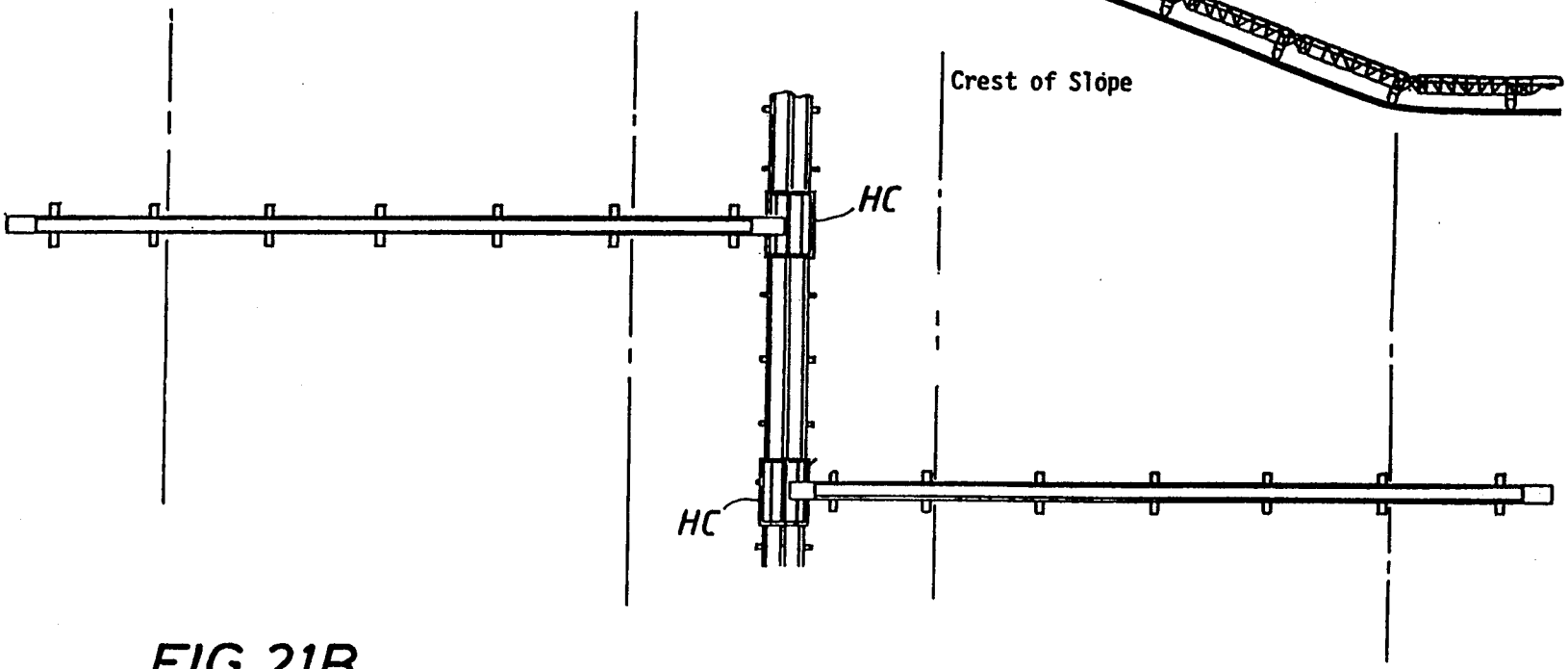
Figure 22:
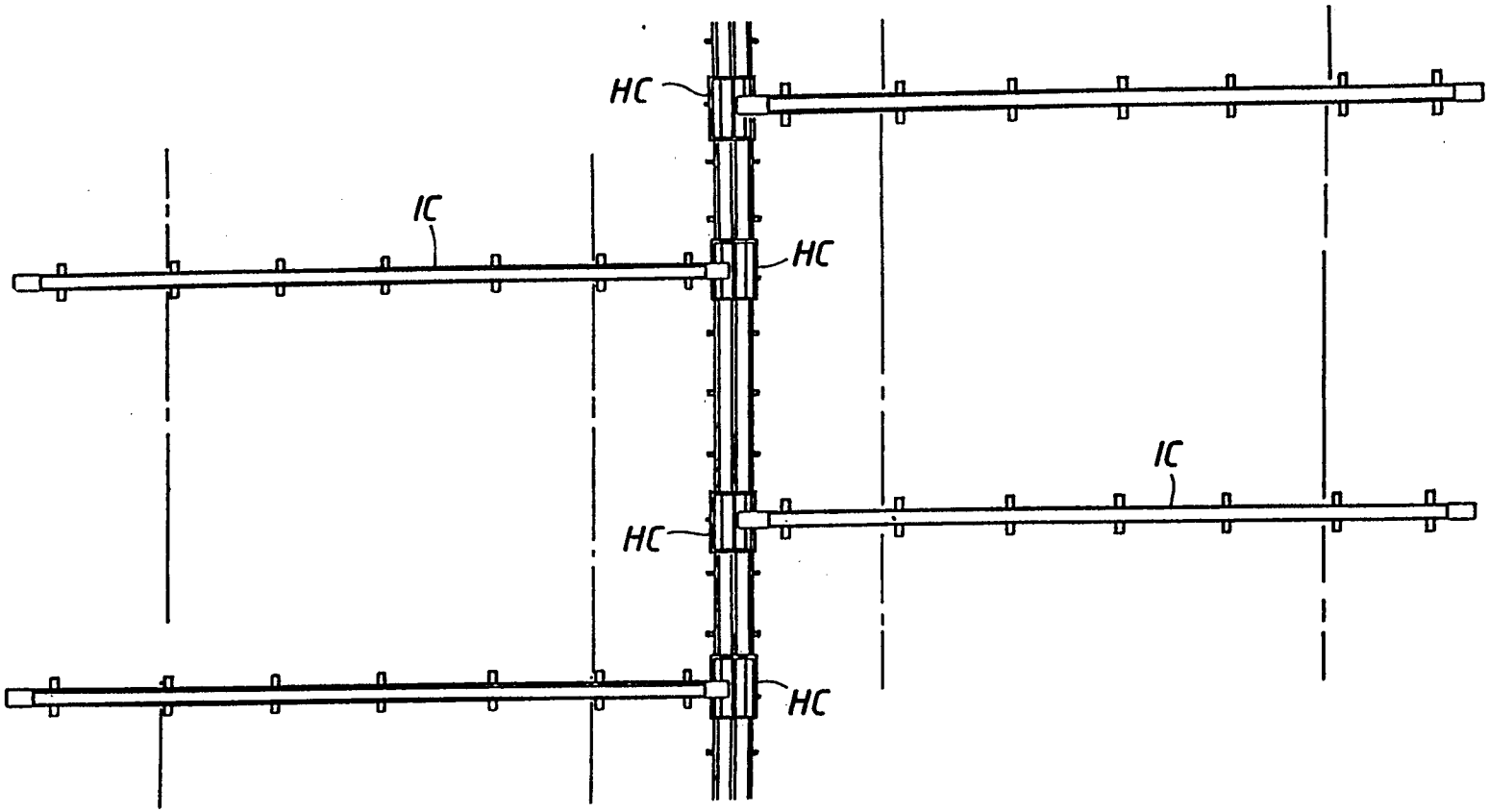

FIGS. 9A, 9B and 9C are cross-sectional views of an inclined mining surface showing the continuous surface miner and mobile conveyor as they approach a pit wall, with the conveyor at a level above the miner being moved away from the wall in order to excavate another slice from the surface, with ramps formed by either dozing or spreading excavated materials with the discharge conveyor and dozing it into position;

FIGS. 9A-1, 9B-1 and 9C-1 are similar cross-sectional views of an inclined mining surface showing the continuous surface miner and mobile conveyor as they approach a pit wall, also with the conveyor at a level above the miner being moved away from the wall in order to excavate another slice from the surface, but with, ramps formed by using the cross tilt feature of a surface miner;

FIGS. 10A, 10B and 10C are views similar to FIGS. 9A, 9B and 9C, but as the miner and conveyor approach the pit wall when the miner is excavating above the conveyor, with ramps formed by either dozing or spreading excavated materials with the discharge conveyor and dozing it into position;

FIGS. 10A-1, 10B-1 and 10C-1 are views similar to FIGS. 9A-1, 9B-1, and 9C-1, also as the miner and conveyor approach the pit wall and the miner is excavating above the conveyor, but with ramps formed by using the cross tilt feature of a surface miner;

FIGS. 11A, 11B and 11C are similar views but as the miner operates both above and below the conveyor, with ramps formed by either dozing or spreading excavated materials with the discharge conveyor and dozing it into position;

FIGS. 11A-1, 11B-1, and 11C-1 are views similar to FIGS. 11A, 11B, and 11C, also as the miner operates both above and below the conveyor, but with ramps formed by using the cross tilt feature of a surface miner;

FIGS. 12A, 12B and 12C are cross-sectional views of a inclined mine surface with the ends of a mobile conveyor extending over the crest and toe of the surface, the dotted lines of FIG. 12A showing the slices excavated by the miner from the position of FIG. 12B to the position of FIG. 12C and the advance of the upper end of the conveyor over the crest of the surface shown in FIG. 12B as they are excavated;

FIGS. 13A and 13B are respectively cross-sectional views and plan views of an inclined mine surface showing a mobile conveyor being walked from the lower position of FIG. 13A to the upper position of FIG. 13B;

FIGS. 14A, 14B, 14C and 14D are respectively vertical sectional views of an inclined surface as a miner approaches the top of the slope, the bottom of the slope, and as it moves into the lower and upper ends respectively of the slope;

FIGS. 15A and 15B are plan views of a miner and mobile conveyor operating on an incline, with FIG. 15A showing the miner as it turns around at the crest of the slope and FIG. 15B showing it as it turns around at the toe of the slope;

FIGS. 16A and 16B are vertical sectional views of an inclined mine surface showing alternative arrangements of a face conveyor at the crest adjacent the upper end of the mobile conveyor;

FIGS. 17A and 17B are vertical sectional views of an inclined mine surface showing alternative arrangements of a face conveyor at the toe adjacent the lower end of the mobile conveyor;

FIGS. 18A and 18B are cross-sectional views of an inclined mine surface with a reversible mobile conveyor disposed thereon for conveying material to either a top slope (FIG. 18A) or bottom slope (FIG. 18B) conveyor;

FIG. 19 is a side view of an inclined mine surface with a mobile conveyor having a face conveyor at one end to receive a valuable commodity and a spreader stacker system at the other end to receive waste material for direct disposal in the dump;

FIG. 20 is a side view of two inclined mine surfaces one above the other with a central face conveyor on a bench between mobile conveyors on each inclined surface;

FIG. 21A and 21B are side and plan views of an inclined mine surface similar to that of FIG. 20, but spaced laterally apart and having parallel face conveyors on the bench adjacent their ends; and FIG. 22 is a plan view of an inclined mine surface similar to FIG. 21B, but with a pair of inclined mobile conveyors on opposite sides of the parallel face conveyors on the intermediate bench.

As shown somewhat diagrammatically in FIGS. 1, 1A and 1B as well as other drawings of this application, the continuous surface miner "CSM" includes a crawler type frame on which a bucket type excavating head H is mounted for forward movement upwardly along the inclined surface IS in order to remove a strip S of material therefrom. As previously indicated, the strip may be a valuable commodity or waste material, which may or may not be associated with the valuable commodity. As well known in the art, a CSM is distinguished from other types of excavators in that the head H has limited if any slewing capabilities.

More particularly, the CSM includes a transfer conveyor TC also mounted on the crawlers for swinging movement from one side to the other in order to transfer the excavated material onto an inclined conveyor IC arranged on the inclined surface to either side of the CSM. As previously indicated, this ability to transfer to either side permits the CSM to be operated to remove a strip of material from the inclined surface whether moving up (FIGS. 1 and 1A) or down (FIG. 1B) the inclined surface. In this respect, the CSM differs from the other type of continuous surface miner previously described as having the capability of transferring material to only one side. Surface miners suitable for the purposes of the present invention include various models of the "Easi Miner" manufactured by Huron Manufacturing, those manufactured by Wirtgen, the "C-Miner" proposed by P. W. H. Paurat, the "Satterwhite Excavator" manufactured by McNally Pittsburgh, Krupp surface miners manufactured by Krupp Industrietechnik GmbH and others that have been built or will be built in the future.

As shown, the IC is disposed along the inclined surface IS above and in the direction of advance of the CSM laterally across the pit. As previously described, it is of such length that its front and rear ends extend over the crest and toe of surface as the CSM is excavating a strip. Obviously, deeper excavations require more and shallower excavations require less conveyor on the slope. As can be seen from a comparison of FIGS. 1A and 1B, the 1C is so spaced from the CSM that it need not be moved laterally during the next traverse, up or down, of the CSM, the angle of the TC merely being adjusted to the space between them.

As previously indicated, the IC comprises a succession of mobile segments MS flexibly connected in end-to-end relation to provide a conveyor of desired length. More particularly, the IC includes a common continuous conveyor belt B on the upper surfaces of the segments. The conveyor segments are of a type which may be moved longitudinally or laterally, as, for example, by means of adjustable wheels or crawlers on their bases. The belt is driven selectively in one or opposite directions by a suitable drive system (not shown).

As shown in FIGS. 2, the length of the inclined surface IS may vary across the width of the mine such that, for example, there is greater or lesser length of conveyor over the crest or toe of the slope (FIGS. 2A, 2B, 3A and 3C) which may be the naturally occurring depth of excavation due to a changing base of the excavation.

As the mobile inclined conveyor breaks over the top edge of the slope, the crest of the slope will, in general, be rounded so that the bottom of the mobile inclined conveyor will not contact the ground, as might occur when one supported end of a conveyor segment is down the slope and the other end of the segment is beyond the crest. Likewise, where the mobile inclined conveyor breaks off the slope and onto the floor or bench, the bottom can be rounded to provide easier reach for the discharge conveyor of the CSM to the mobile inclined conveyor.

Figure 4:
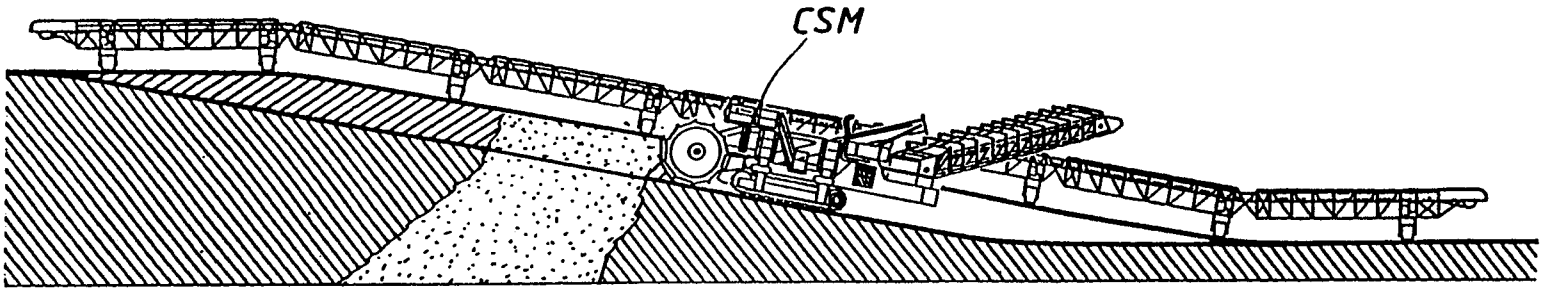
FIG. 4 is a vertical sectional view of an inclined mine surface having an interface between seams of different material and showing a continuous surface miner and mobile conveyor thereon with the miner stopped just prior to excavating a different material.
Figure 5:
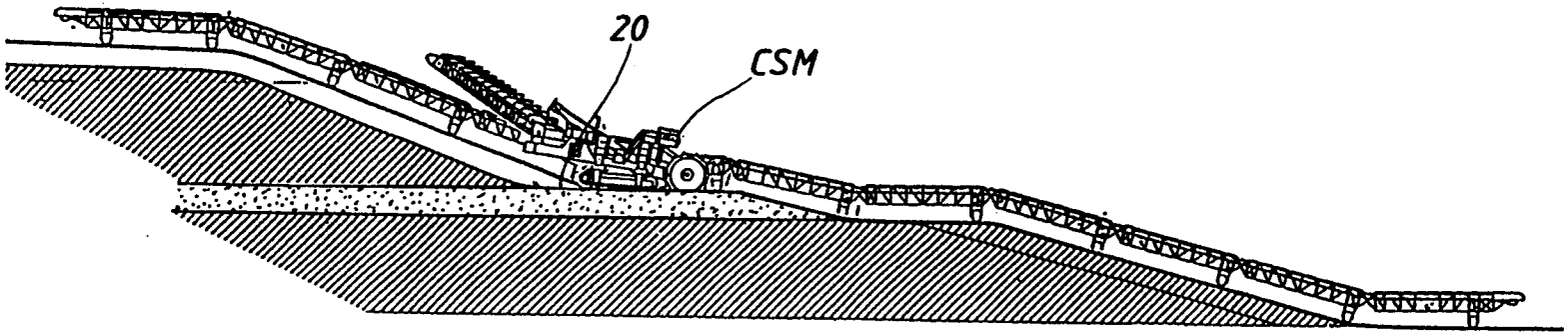
FIG. 5 is a vertical sectional view of another inclined mine surface having a bench formed thereon at the interface of the different materials.

As the CSM proceeds up or down slope and comes to a defined material boundary change or interface, as shown by the darkened area in FIG. 4, it can be stopped momentarily to allow the belt of the mobile inclined conveyor to clear, following which the excavation can continue. When the empty spot on the belt reaches a diversion point, the following material can be routed to a different destination. With a detector to identify the change in material types, the rerouting can be achieved automatically. Alternatively, if the material change is gradational or the separation need not be precise, the excavator need not be stopped and the material can be rerouted without interruption.

Where a clean separation is required, a short offset bench 20 can be formed intermediate upper and lower inclined surfaces, as shown in FIG. 5. This will both physically separate the materials on the bench and provide the break on the conveyor required for segregating and rerouting the materials. The material then would be routed to the appropriate destination elsewhere in the system.

The above offset concept can be expanded to provide for mining only one type of material during a specified operating period. The CSM can turn around on the offset bench 20 if made sufficiently wide and the excavation of either waste or valuable commodity continued. Alternatively, one or the other material may be by passed and excavated during a later production run.

Larger capacities than capable from one CSM can be achieved by feeding a single bench top or bottom transportation system with several parallel IC's and associated CSM's. Redundant inclined systems feeding a single bench transportation system not only provide increased capacity, but also potential quality/grade control blending capability and higher system reliability.

Within materials being excavated by the CSM, there may occur zones, bands, beds, or boulders of materials too hard and/or too large for the CSM to mechanically excavate. Because the material is exposed from the top down (in contrast to a shovel or a bucket wheel excavator which exposes these materials from the open bench face), it is a simple matter to ride up over or go around such materials which can then be broken by drilling and blasting or using a hydraulic breaker and dozed out of the way for later rehandling.

As it moves up and/or down the slope adjacent to the mobile inclined conveyor, the CSM may excavate more than one strip deep and/or more than one strip wide before moving the mobile inclined conveyor. This of course depends on the geometry of the excavator, the depth of cut, the discharge conveyor length, the stability of the cuts being made, and the operating practices being followed. The mobile inclined conveyor moves across the slope as the excavation progresses its excavation of up and down slope strips until an entire slice is removed from the surface.

FIGS. 6, 7 and 8 illustrate three typical excavation sequence of a CSM while operating on an inclined surface to one side of a mobile IC, wherein the CSM can work either below, above or above and below the surface on which the mobile conveyor travels. Thus, in FIG. 6, the CSM is excavating a slice which is two strips deep, each strip being shown diagrammatically in rectangular form with the strips to be excavated by the CS being shown by hatched lines. In this case, of course, the conveyor is positioned above the surface on which the CSM is operating, and the reach of the CSM is such that it may remove two horizontal rows of strips before the conveyor must be repositioned.

FIG. 7 shows the CSM working above the surface on which the conveyor is disposed, with removed strips being shown in dotted lines and those to be excavated being shown by cross hatching. As shown in FIG. 8, a CSM may operate either above or below the conveyor, with material to be transferred by each CSM to the conveyor between them.

When excavation across the sloped face approaches the side wall of the pit, the mobile conveyor must be positioned on the next surface it will follow to move another slice on the return pass across the slope. In the case where the mobile inclined conveyor operates above the CSM, as shown in FIGS. 9A, 9B and 9C, as well as 9A-1, 9B-1, and 9C-1, the drop caused by the miner is benched in a series of steps (FIG. 9A and 9A-1) so that short ramps can be developed in front of each crawler or wheel set of the mobile conveyor to permit the conveyor to be moved to the lower level, as shown in FIG. 9B and 9B-1. As previously mentioned, these ramps can be formed by either dozing them into place or spreading excavated materials and dozing into place or by using the cross-tilt feature of the surface miner when cutting the benches. The material remaining upon which the conveyor previously was positioned is then excavated by the CSM loading to the inclined conveyor on a lower level, as shown in FIGS. 9C and 9C-1. The CSM then continues to excavate to reestablish the configuration with the conveyor above the excavating level.

As illustrated in FIGS. 10A, 10B and 10C, as well as 10A-1, 10B-1, and 10C-1, the procedure for lowering the conveyor to the next level is similar to the above sequence where the CSM excavates above the conveyor. At the end of a pass across the slope, the CSM continues to excavate until the desired depth is reached and a step configuration developed suitable for developing ramps. The ramps are then developed to permit the conveyors moved to the next lower level (FIGS. 10B and 10B-1). These ramps can be developed using the techniques described above.

In the case where the CSM works above and below the sloped conveyor, a combination of the activities described above are required to move the conveyor to the next level, as illustrated in FIGS. 11A, 11B and 11C as well as 11A-1, 11B-1 and 11C-1.

As the inclined conveyor is dropped from one pass to the other, the crest and toe of the slope will be advanced along the conveyor, as shown in broken lines in FIG. 12A. The length of conveyor extending beyond the crest of the slope (FIG. 12B) will control the requirement to move the conveyor (FIG. 12C) in the direction of its long axis as the excavation progresses.

Movement of the mobile conveyor in the long axis direction can be accomplished in two ways. First, if the mobile conveyor is equipped with the ability to travel in the direction of the long axis as well as in the transverse direction, it can simply be moved up the existing slope formed by the excavator. In order to effect a rotation of the tracks or wheels to move the conveyor up the slope along its long axis, some translation may be required to effect the track/wheel change of direction.

If not equipped with the ability to move in the long axis direction, the conveyor can be advanced on the slope by pivoting it about the top and then about the bottom to return the conveyor to the proper direction. The conveyor can then be walked into the required position, as illustrated in FIGS. 13A and 13B. This procedure to advance the mobile inclined conveyor into the desired position can be accomplished through a variety of rotational and translational moves. The bench transportation system must be moved forward also so the excavated material can be moved away from the active mining area.

As the Continuous Surface Miner approaches the top or bottom of the inclined advance, the strip being excavated will feather out leaving no material behind, as shown in FIGS. 14A, 14B, 14C and 14D. This is a very significant advantage of the use of the incline mining surface striking in the advance direction. Other arrangements result in materials being left behind that need later rehandling if the excavator cannot mine right up to the face at the end of the cut or turn in the cut. Turning the CSM 180 degrees in order to make a return parallel pass would also require some awkward maneuvering when the CSM is faced up against a pit wall.

The turn around radius of the machine will define the space required at the bottom or top of the slope. The turn around space limitation imposed by the mining system of this invention are two-fold. First, if the transportation system (for instance a face conveyor) blocks access beyond the end of the mobile inclined conveyor, then the mobile inclined conveyor must extend beyond the end of the cut a sufficient distance to place the obstruction out of the way of the machine's turn around space, as shown in FIGS. 15A and 15B.

Secondly, as a face conveyor traverses across slope, a situation will eventually occur where the distance between the side wall of the pit and the mobile face conveyor will limit the turn around space for the continuous surface miner. If the machine cannot turn in this distance and access beyond the end of the mobile inclined conveyor is blocked, then the mobile inclined conveyor will need to be moved out of the way to provide the turn around space. After the turn around of the CSM is completed, then the mobile inclined conveyor will need to be returned to the required position to receive the discharge from the excavator. Alternatively, the excavator can be backed up to the other end of the slice and the excavation conducted in only one direction until conditions where a turn around can be executed are again established.

As shown in FIGS. 16A and 16B, a face conveyor FC located at the top of the inclined mining slope and charged with material from the mobile inclined conveyor IC can be provided to remove the material from the active mining area. This face conveyor will advance periodically as the inclined mining slope advances. The periodicity of the movement of the top of slope face conveyor will be determined by the length of the mobile inclined conveyor that extends over the top of the slope (immediately after the previous face conveyor advance) and the rate at which material is being mined for a slope of given width and depth. The face conveyor may be of the shiftable or mobile type and the advance of the face conveyor managed accordingly.

A top of slope face conveyor works well where the surface is relatively flat. If, however, the surface undulates, the discharge end of the mobile inclined conveyor IC will move off the face conveyor FC as the mobile inclined conveyor moves across the strike of the inclined face. Unless the face conveyor is very mobile, the alignment of the discharge end of the mobile inclined conveyor must be accommodated by an adjustment of the mobile inclined conveyor along its long axis. Alternatively, and as shown in FIG. 16B, a transfer conveyor TC' can be provided to accommodate the adjustment between the face conveyor and the mobile inclined conveyor.

As shown in FIGS. 17A and 17B, a face conveyor FC may also be located at the bottom of the inclined mining slope and charged with material from the mobile inclined conveyor IC to remove the material from the active mining area. The face conveyor will advance periodically as the inclined mining slope advances. The frequencies of movement of the bottom of slope face conveyor will be determined by the length of the mobile inclined conveyor that extends beyond the bottom of the slope (immediately prior to the next face conveyor advance) and the rate at which material is being mined for a slope of given width and depth. The face conveyor may be of the shiftable or mobile type and the advance of the face conveyor managed accordingly.

If, however, the floor undulates, the discharge end of the mobile inclined conveyor will move off the face conveyor as the mobile inclined conveyor moves across the strike of the inclined face, the problem may be solved in the same manner as the bottom of slope face conveyor (see FIG. 17B) — namely, a transfer conveyor TC'.

The inclined mobile conveyor IC can be built to be reversible so that materials placed on the belt can be moved either up or down slope. A face conveyor FC can be located at the top and bottom of the slope and materials selectively routed to either face conveyor, as shown in FIGS. 18A and 18B. This arrangement requires greater coordination of top and bottom of slope face conveyor movement. The frequency of face conveyor advance will be governed by the same factors described for the top of slope conveying system or the bottom of slope conveying system.

As shown in FIG. 19, a reversible mobile conveyor IC permits valuable commodities and/or waste materials to be diverted to the bottom of slope face conveyor or to a spreader stacker system SS for direct disposal of waste in the dump. Situations can be expected, however, where the valuable commodity is directed to the bottom of the slope and the waste to the top. This ability to use one system to serve several functions can lead to substantially reduced capital and operating cost for implementation of a mining system.

As shown in FIG. 20, mobile inclined conveyors IC can be arranged on two inclined mining faces, one above and one below, to feed to a central face conveyor FC on a bench between the two slopes. The mobile inclined conveyor on the upper slope would feed down grade to the central face conveyor, and the mobile inclined conveyor on the lower slope would feed up grade to the central face conveyor. A logical position for the central face conveyor would be on the top of a geological horizon such as the top of coal. The material above would be waste and the material below would be coal. The mining system would be designed to run either coal or waste.

Many situations can be visualized such as multiple seam deposits, or one with varying geological contacts, where this application would also be advantageous. The valuable commodity and the waste can be mined and transported sequentially, and separated at a flop gate downstream in the system. In this way, when several different products are transported on one mobile inclined conveyor, they can be routed to the appropriate destinations as discussed previously.

Because the bench on which the central face conveyor FC is situated is excavated by the mining system, its position can be controlled. This feature can be used to simplify the coordination of the alignment of the mobile inclined conveyor with the face conveyor as discussed previously. This feature may reduce or eliminate the advantage of transfer conveyors to facilitate the alignment between the face conveyor and the mobile inclined conveyor, as previously discussed.

The sharing of a central face conveyor by two separate mobile inclined conveyors, one operating down slope and the other up slope leads to some unique opportunities. System reliability and productivity can be improved through integration of redundant mining equipment for shared applications. Thus, as shown in FIGS. 21A and 21B, the capacity of the two systems can be increased by placing a second face conveyor parallel and adjacent to the first face conveyor. Both systems can be run concurrently feeding separate downstream conveying systems.

By providing the capability to feed either face conveyor from either mobile inclined conveyor, as by means of a flop gated hopper car HC, priority can be given to one product over the other in the event of failure of one of the face conveyors. This increases the reliability of either system to move material on demand. However, proper overall sizing of the systems should provide enough capacity so that this is not a problem but rather an advantage.

In this case, the two face conveyors could be mounted on the same shifting or mobile structures enabling them to be advanced together. This would save time, reducing out of service delays. The close proximity of the two conveyors would facilitate the dual usage of the conveyors described in the above paragraph. The frequency of conveyor advance would be governed by the considerations discussed previously.

Addition of redundant continuous surface miners and mobile inclined conveyors to a system with redundant face conveyors can lead to very high availabilities for mining of the priority product (FIG. 22). As long as there is sufficient overall capacity in the system to reach total volume requirements, sharing of the transportation system can provide maximum system reliability at minimum capital and operating cost.

The availability and total productive capacity of the entire mining system can be increased as more of the downstream transportations systems can be shared by both the valuable commodity being produced and the waste material being discarded or as additional redundancy is built in by paralleling single systems.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a method of surface mining wherein a portion of the mine surface is inclined in the direction of the advance of the excavation, the steps of moving a continuous surface miner having a discharge conveyor up the inclined surface so as to excavate a strip of the geological horizon of valuable commodity and/or waste material therefrom, turning the miner around at the crest of the inclined surface and moving it down the inclined surface so as to excavate a laterally adjacent strip of material therefrom, turning the miner around at the toe of the inclined surface in preparation for further movement up the inclined surface and continuing to move it up and down the inclined surface and turning it around at the crest and toe thereof in order to excavate a slice of laterally adjacent strips of material therefrom as the miner moves laterally across the excavation, disposing a conveyor comprising flexibly connected, end-to-end mobile segments having a common continuous conveyor belt generally parallel to the path of movement of the continuous surface miner and with its upper and lower ends extending beyond the crest and toe of the inclined surface, respectively, transferring the excavated material from the discharge conveyor of the miner to the belt of the inclined conveyor as the miner is so moved, and moving the material on the conveyor belt of the inclined conveyor in a direction toward either the crest of toe of the inclined surface for transportation to another destination.

2. In a method of the character defined in claim 1, wherein the inclined surface from which the material is excavated is on the inclined surface on which the conveyor is disposed.

3. In a method of the character defined in claim 1, wherein the inclined surface from which the material is excavated is above the inclined surface on which the conveyor is disposed.

4. In a method of the character defined in claim 1, wherein the inclined surface from which the material is excavated is below the surface on which the conveyor is disposed.

5. In a method of the character defined in claim 1, wherein a miner is disposed on each side of the inclined surface so that the inclined surface from which the material is excavated is above and below the surface on which the conveyor is disposed.

6. In a method of the character defined in claim 1, including the step of moving a miner up and down an inclined surface beneath an inclined surface from which strips of the material have been previously excavated so as to excavate a slice which is at least two strips thick.

7. A method of the character defined in claim 1, including the step of disposing a face conveyor laterally along the crest and/or toe of the inclined surface so as to receive excavated material from the adjacent end of the mobile conveyor.

8. A method of the character defined in claim 7, wherein the mobile conveyor is reversible, and a face conveyor is disposed laterally along the crest and toe of the inclined surface so as to receive material from the mobile conveyor during up or down movement of the conveyed material.

9. A method of the character defined in claim 8, wherein the conveyor is of such length that its ends extend over the crest and toe so as to accommodate an inclined surface of variable lengths from one side to the other as it is moved laterally thereacross.

10. A method of the character defined in claim 1, including moving the conveyor laterally across the inclined surface as the miner moves thereacross to excavate a strip therefrom.

11. A method of the character defined in claim 1, including the step of moving the miner from one inclined surface to another so as to remove successive slices of valuable commodities and/or associated waste therefrom in the direction of advance.

12. A method of the character defined in claim 1, including the step of advancing the conveyor up the inclined surface as successive slices of valuable commodities and/or waste are removed therefrom so as to maintain its ends over the crest and/or toe of the inclined surface.

13. A method of the character defined in claim 12, including the step of disposing a face conveyor laterally across the crest and/or toe of the inclined surface so as to receive excavated material from the adjacent end of the mobile conveyor, moving the face conveyor so as to accommodate upward movement of the inclined conveyor.

14. A method of the character defined in claim 12, including the steps of disposing a face conveyor across the crest and/or toe of the mobile surface, and disposing a transfer conveyor between the end of the mobile conveyor and the face conveyor to accommodate upward movement of the inclined conveyor.

15. A method of the character defined in claim 1, including the steps of moving the inclined conveyor operating on an inclined surface level above that on which the miner is operating into position for a new advance by causing the miner to form successively stepped levels of inclined mining surfaces between the lower surface and the upper surface on which the conveyor is located as it approaches a side wall of the mine, forming ramps between the lower surface and the upper surface on which the conveyor is located at positions in front of the conveyor, and moving the conveyor laterally down the ramps to the lowest level in preparation for initiating excavation of a new advance.

16. A method of the character defined in claim 1, including the step of moving the inclined conveyor operating on a surface below that on which the miner is operating into position for a new advance by completing the advance to the side wall of the pit causing the miner to form successively stepped levels of inclined mining surfaces between the inclined conveyor surface and the new lower inclined surface on which the conveyor is to be located, forming ramps in front of the conveyor between the upper inclined surface and the lower inclined surface on which the conveyor is to be located, and moving the conveyor laterally down the ramps onto the lowest level in preparation for initiating excavation of a new advance.

17. A method of the character defined in claim 1, including the steps of moving the inclined conveyor operating on a surface intermediate to inclined surfaces on which miners operate to a new advanced intermediate inclined surface by completing the advance to the side wall of the pit of the part of the surface above the intermediate conveyor, causing the miner to form successively stepped levels of inclined mining surfaces between the intermediate surface and the lower surface on which the miner excavates, forming ramps in front of the conveyor between the intermediate conveyor inclined surface and the lower inclined surface on which the conveyor is to be located, moving the conveyor laterally down the ramps onto the lowest level, causing the miner to form successively stepped levels of inclined mining surfaces between a new lower intermediate inclined surface for the inclined conveyor and the upper inclined surface on which the conveyor is located after the initial move above, forming ramps between the new intermediate inclined surface and the upper inclined surface on which the conveyor is located at positions in front of the conveyor, moving the conveyor laterally down the ramps onto the intermediate level, and excavating successively lower strips between the end wall and the inclined conveyor until a new advance is established.

18. A method of the character defined in claim 1, including the step of reversing the direction of movement of the conveyor as to alternately transfer material to the crest or toe of the inclined surface.

19. A method of the character defined in claim 1, including the step of interrupting movement of the miner at a transition from one material to another to create a separation of the material on the conveyor as it continues to move.

20. A method of the character defined in claim 19, including the step of transferring different materials from the miner onto the conveyor as the miner successively excavates them, and separating the materials downstream.

21. A method of the character defined in claim 1, including the step of forming an intermediate bench between upper and lower sections of the inclined surface so as to segregate the excavation of valuable commodities and/or associated waste therefrom.

22. A method of the character defined in claim 1, including the steps of disposing another conveyor along another inclined mining surface having its crest separated from the toe of the first described surface by a bench, and disposing a face conveyor laterally across the bench to receive material from both inclined conveyors.

23. A method of the character defined in claim 22, wherein the bench is at the top of the geological horizon of a valuable commodity.

24. A method of the character defined in claim 1, including the step of disposing another conveyor along another inclined mining surface having its crest separated from the toe of the first described surface by a bench, and disposing a pair of side-by-side face conveyors laterally across the bench, one to receive material from the inclined conveyor and the other to receive material from the other inclined conveyor.

25. A method of the character defined in claim 24, including the step of mounting both face conveyors on a mobile support structure for advance together.

26. A method of the character defined in claim 25, including the step of disposing a pair of conveyors in side-by-side relation on each inclined surface.

27. A method of the character defined in claim 26, including the step of disposing a flop gated hopper between the end of each inclined conveyor to permit selective transfer of material from that inclined conveyor to either of the face conveyors.

* * * * *